US010435898B2

(12) United States Patent
Webb

(10) Patent No.: US 10,435,898 B2
(45) **Date of Patent: *Oct. 8, 2019**

(54) GROUP PRIVACY STRUCTURE AND CONFIGURATIONS OF GROUP PRIVACY STRUCTURES

(71) Applicant: Douglas Arthur Webb, Lewis Center, OH (US)

(72) Inventor: Douglas Arthur Webb, Lewis Center, OH (US)

(73) Assignee: Doug Webb, Lewis Center, OH (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/757,044

(22) Filed: Nov. 11, 2015

(65) Prior Publication Data

US 2016/0138286 A1 May 19, 2016

Related U.S. Application Data

(63) Continuation of application No. 14/326,386, filed on Jul. 8, 2014, now Pat. No. 9,222,273.

(51) Int. Cl.

| | |
|---|---|
| ***E04H 1/04*** | (2006.01) |
| ***E04H 1/02*** | (2006.01) |
| ***E04H 1/00*** | (2006.01) |
| ***E04H 17/00*** | (2006.01) |

(52) U.S. Cl.

CPC ..... *E04H 1/04* (2013.01); *E04H 1/005* (2013.01); *E04H 1/02* (2013.01); *E04H 17/00* (2013.01)

(58) Field of Classification Search

CPC ..... E04H 1/04; E04H 17/00; E04H 1/005; E04H 1/02

USPC ..... 52/79.1, 169.2, 169.3, 234

See application file for complete search history.

(56) References Cited

U.S. PATENT DOCUMENTS

| | | | | | |
|---|---|---|---|---|---|
| 374,378 | A | * | 12/1887 | Strong | E02B 3/10 405/107 |
| 3,640,037 | A | * | 2/1972 | Renauld | E04H 1/02 52/169.3 |
| 3,732,649 | A | * | 5/1973 | Mehran | E04H 1/00 52/169.3 |
| 3,993,006 | A | * | 11/1976 | Connolly | A47F 10/00 109/1 R |
| 3,996,709 | A | * | 12/1976 | Coxe | E04H 1/00 52/169.3 |

(Continued)

FOREIGN PATENT DOCUMENTS

| | | | |
|---|---|---|---|
| JP | 2006193972 A | * | 7/2006 |
| JP | 2008127746 | * | 6/2008 |

*Primary Examiner* — Joshua K Ihezie

(57) ABSTRACT

A structure and its adjacent group-segregated outdoor spaces or an arrangement of structures and their adjacent group-segregated outdoor spaces includes at least one structure comprising at least one a unit and at least one b unit. The areas adjacent to the structure or structures are physically separated into a first group-segregated outdoor space and a second group-segregated outdoor space. The first group-segregated outdoor space is associated with the at least one a unit. The second group-segregated outdoor space is associated with the at least one b unit. The areas adjacent to the structure or structures are physically separated by a barrier, whereby the barrier at least partly limits visibility and access between the first and second segregated outdoor areas.

28 Claims, 24 Drawing Sheets

(56) References Cited

U.S. PATENT DOCUMENTS

| | | | | | |
|---|---|---|---|---|---|
| 4,007,565 | A * | 2/1977 | Finnegan | E04H 1/00 | 52/169.3 |
| 4,575,977 | A * | 3/1986 | Taylor | F24J 2/04 | 126/569 |
| 4,796,398 | A * | 1/1989 | Golovko | E02D 27/32 | 52/169.2 |
| 5,469,673 | A * | 11/1995 | Raynor | E04H 1/00 | 52/169.2 |
| 5,761,857 | A * | 6/1998 | Kaufman | E04H 1/00 | 52/169.2 |
| 6,182,408 | B1 * | 2/2001 | Poehler | E04H 1/02 | 52/200 |
| 6,405,496 | B1 * | 6/2002 | Stewart | E04H 6/10 | 52/169.3 |
| 6,578,330 | B1 * | 6/2003 | Bergman | E04H 1/04 | 52/234 |
| 6,688,052 | B1 * | 2/2004 | Flanders | E04H 1/005 | 52/169.2 |
| 8,279,219 | B2 * | 10/2012 | Ghazali | E04H 1/005 | 345/423 |
| 2001/0039768 | A1 * | 11/2001 | Bigelow | E04B 1/34815 | 52/79.1 |
| 2006/0059792 | A1 * | 3/2006 | Tiramani | E04B 1/3442 | 52/79.1 |
| 2007/0210295 | A1 * | 9/2007 | Smith | E04H 17/22 | 256/65.14 |
| 2010/0180518 | A1 * | 7/2010 | Postlethwaite | E04H 3/08 | 52/79.1 |
| 2011/0296789 | A1 * | 12/2011 | Collins | E04B 1/24 | 52/741.4 |
| 2013/0239487 | A1 * | 9/2013 | Ingjaldsdottir | E04C 2/384 | 52/79.1 |

* cited by examiner

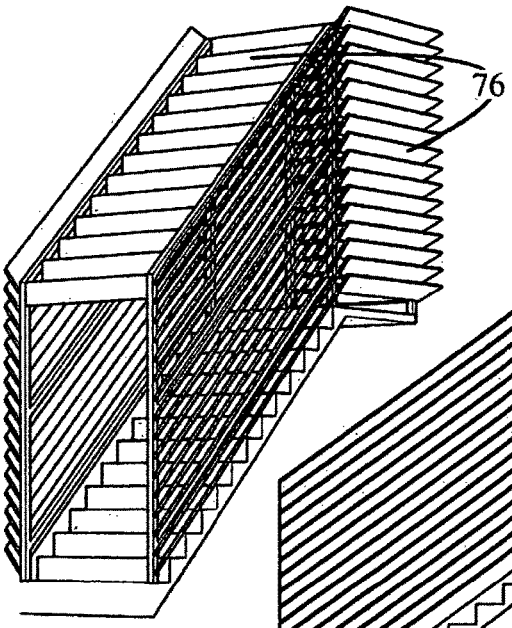
Fig. 8A
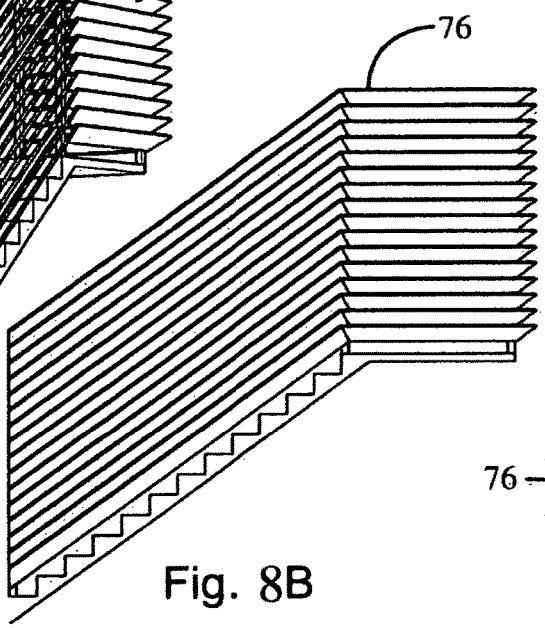
Fig. 8B
Fig. 8C
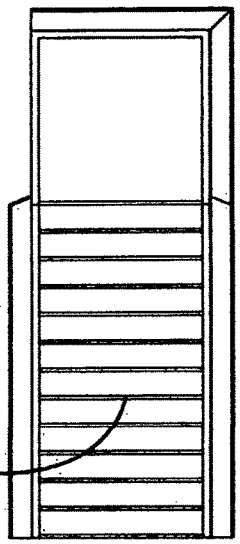
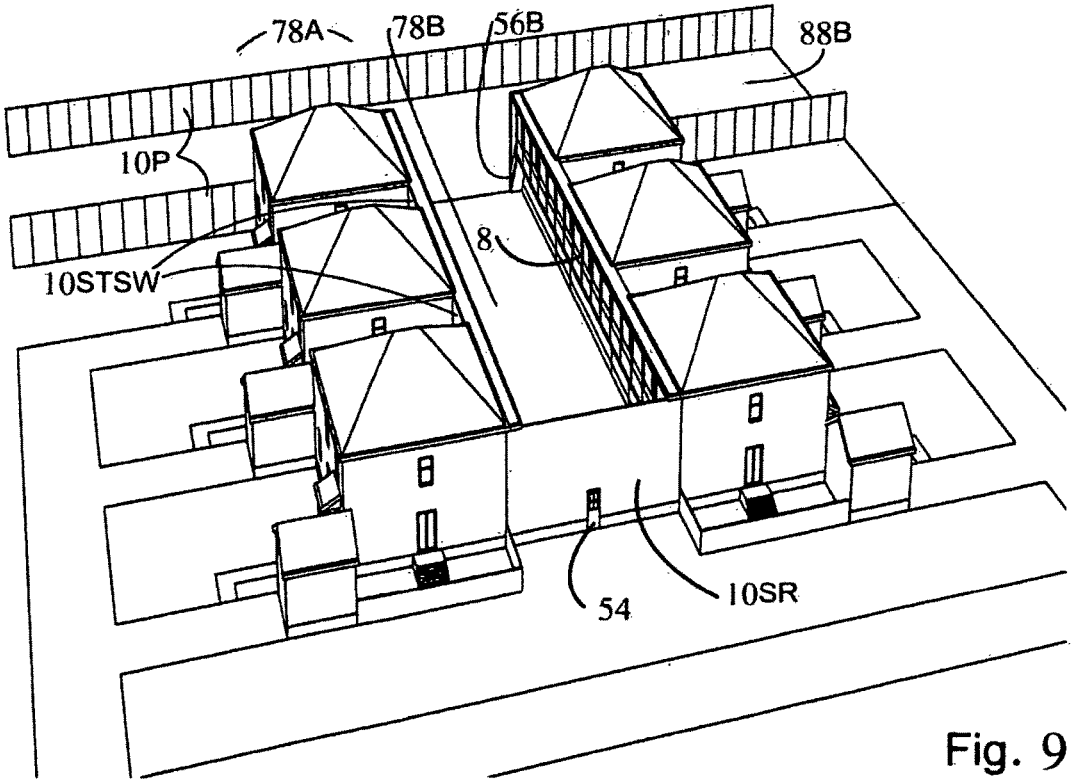
Fig. 9

GROUP PRIVACY STRUCTURE AND CONFIGURATIONS OF GROUP PRIVACY STRUCTURES

FIELD OF THE INVENTION

This invention is directed generally to building structures and, in particular, to building configurations involving privacy arrangements.

BACKGROUND

Real estate designs have mostly focused on providing privacy for each building or each unit within a building from its neighboring building or units. There exists a need to provide privacy between two groups in particular building arrangements such as owners and renters who occupy owner-occupied multifamily dwellings.

Owner-occupied twin or duplex homes are known in the art, whereby the owner lives on one side of the building and rents the other side. These dwellings provide no group privacy and consequently many have converted to all rental units. Additionally, some older single family homes have been converted into multifamily dwellings by adding an alley at the back for parking. These are often found on college campuses where older homes have converted to off campus apartments. Other multifamily dwellings called flats copied this idea to enable parking at the front and back. These communities of flats were originally conceived for owners to live on one entire floor with a rental unit on a second floor and, if it was a 3 flat, a rental unit on a third floor. The front and back parking did not solve any group privacy issues. That arrangement was a means to provide additional parking and not an attempt at improving privacy between owners and renters.

Real estate construction is unique in that it must be built to building, fire and zoning codes among other restrictions. These codes have become much more restrictive in recent years. Older dwellings have not been built to meet local modern building, fire, or zoning codes or other requirements. There remains a need for a building arrangement that provides sufficient privacy, accommodates two or more entities, and meets all necessary code requirements.

BRIEF SUMMARY

In accordance with a preferred embodiment of the present invention, an arrangement of structures and their adjacent group-segregated outdoor spaces is provided, where two or more structures comprise at least one a unit and at least one b unit, the areas adjacent to the two or more structures are physically separated into a first group-segregated outdoor space and a second group-segregated outdoor space, the first group-segregated outdoor space is associated with the at least one a unit, the second group-segregated outdoor space is associated with the at least one b unit, the areas adjacent to the two or more structures are physically separated by a barrier, and whereby the barrier at least partly limits visibility and access between the first and second segregated outdoor areas.

The arrangement may further comprise at least two groups of units where each group of units has one or more entrances and the one or more entrances for each group of units are separate from the one or more entrances for the other group of units. The at least one a unit may comprise 51%-100% of a first floor space. The at least one a unit may comprise 75%-100% of the first floor space. The one or more units of one group of units may have exclusive use of outdoor space that is attached to the structure containing the one or more units yet one or more of units of the group of units does not occupy only first floor space. The one group of units may have access to a parking area that is not attached to a structure containing one or more of the units from the group of units. Elevations of land may be used to increase the height of the barrier compared to the average elevation of the area comprising the arrangement of structures. One group of units may be commercial space. One or more of the units in the one group of units may not occupy first floor space. At least one of the first group-segregated outdoor space and the second group-segregated outdoor space may comprise shared parking such that at least one of the at least one unit a and the at least one unit b shares parking with itself and at least one of the at least one unit a and the at least one unit b has a separate entrance to the shared parking. Two or more of the structures may have three or fewer stories. At least one of the structures may contain two or more units. At least one of the structures may be an owner-occupied multi-family dwelling. One or more of the units of one group of units may not access at least a portion of the group-segregated outdoor space associated with the at least one unit of the other group of units. One or more of the at least one a unit may have useable access to front, back, or side yards, decks, patios, or courtyards that are adjacent to the structure comprising the at least one a unit. One or more of the at least one b unit may have useable access to front, back, or side yards, decks, patios, or courtyards that are adjacent to the structure comprising the at least one b unit.

In accordance with further embodiments of the present invention, a structure arrangement and its adjacent outdoor areas is provided comprising at least one structure comprising at least one a unit and at least one b unit, a first group-segregated outdoor space, and a second group-segregated outdoor space; the first group-segregated outdoor space is associated with the at least one a unit; the second group-segregated outdoor space is associated with the at least one b unit; the first group-segregated outdoor space is separated from the second group-segregated outdoor space by a separation impeding entry to the first segregated outdoor space from the second group-segregated outdoor space; the separation comprises a barrier.

In accordance with further embodiments of the present invention, a structure and its adjacent group-segregated outdoor spaces is provided where at least one structure comprises at least one a unit and at least one b unit, the areas adjacent to the at least one structure are physically separated into a first group-segregated outdoor space and a second group-segregated outdoor space for the at least one a unit and the at least one b unit the first group-segregated outdoor space is associated with the at least one a unit; the second group-segregated outdoor space is associated with the at least one b unit; the areas adjacent to the two or more structures are physically separated by a barrier; and whereby the barrier at least partly limits visibility and access between the first and second segregated outdoor areas.

The at least one b unit may comprise a plurality of b units. A plurality of structures and group-segregated outdoor spaces may comprise the structure and its adjacent group-segregated outdoor space.

In accordance with further embodiments of the present invention, a structure and its adjacent group-segregated outdoor spaces is provided where at least one structure comprises at least one a unit and at least one b unit; the spaces adjacent to the at least one structure are physically separated into a first group-segregated outdoor space and a second group-segregated outdoor space and the spaces adjacent to the at least one structure are physically separated by a barrier; the first group-segregated outdoor space is associated with the at least one a unit; the second group-segregated outdoor space is associated with the at least one b unit; whereby the barrier at least partly limits visibility and access between the first and second group segregated outdoor areas; egress from the at least one b unit is achieved by traveling adjacent to a portion of the first group-segregated outdoor space for the at least one a unit; and the portion of the first group-segregated outdoor space for the at least one a unit comprises a barrier.

In accordance with further embodiments of the present invention, a structure and its adjacent group-segregated outdoor spaces is provided where at least one structure comprises at least one a unit and at least one b unit; the lowest portion of the at least one a unit is disposed at a level of the at least one structure that is disposed at an elevation equal to or above an exterior ground level adjacent to at least a portion of the at least one structure, a portion of the at least one b unit is disposed above the lowest portion of the at least one a unit; the areas adjacent to the at least one structure are physically separated into a first group-segregated outdoor space and a second group-segregated outdoor space for the at least one a unit and the at least one b unit whereby the first group-segregated outdoor space is associated with the at least one a unit, the second group-segregated outdoor space is associated with the at least one b unit and the areas adjacent to the at least one structure are physically separated to at least partly limit visibility and access between the first and second segregated outdoor areas; and an egress structure for the at least one b unit is disposed directly between the at least one b unit and the second group-segregated outdoor space associated with the at least one b unit.

The at least one a unit comprises an egress structure is disposed directly between the at least one a unit and the group-segregated outdoor space associated with the at least one a unit.

In accordance with further embodiments of the present invention, a structure and its adjacent group-segregated outdoor spaces is provided where at least one structure comprises at least one a unit and at least one b unit; the areas adjacent to the at least one structure are physically separated into a first group-segregated outdoor space and a second group-segregated outdoor space for the at least one a unit and the at least one b unit; the first group-segregated outdoor space is associated with the at least one a unit; the second group-segregated outdoor space is associated with the at least one b unit; the areas adjacent to the at least one structure are physically separated by a barrier; whereby the barrier at least partly limits visibility and access between the first and second segregated outdoor areas; at least one group a or group b unit contains at least one void; and where the at least one void provides a view of the group-segregated outdoor space associated with the at least one a unit, at least one b unit, or a void, and at least one of a placement, a use of a non-operable window or void, a means to monitor or discourage use of an emergency use window, door or void, or a view blocking means sufficient to distort, limit, or eliminate the view to the group-segregated outdoor space associated with the group-segregated outdoor space associated with at least one a unit, the group-segregated outdoor space associated with at least one b unit, or a void while allowing light to flow through the one or more voids, whereby the at least one a unit or at least one b unit has light flow without having a view or without having a clear or unobstructed view of another associated group-segregated outdoor space or void.

The at least one void may comprise a plurality of voids.

In accordance with further embodiments of the present invention, a structure and its adjacent group-segregated outdoor spaces is provided, where the structure comprises at least one a unit and at least one b unit; the group-segregated areas adjacent to the structure are physically separated into a first group-segregated outdoor space and a second group-segregated outdoor space for the at least one a unit and the at least one b unit; the first group-segregated outdoor space is associated with the at least one a unit; the second group-segregated outdoor space is associated with the at least one b unit; the areas adjacent to the two or more structures are physically separated by a barrier; and whereby the barrier at least partly limits visibility and access between the first and second segregated outdoor areas; the group-segregated outdoor space for the at least one b unit comprising elements that have been built higher than the elevation of at least some of the group-segregated outdoor space for the at least one a unit; where the barrier disrupts a view of at least a portion of the group-segregated outdoor space for the at least one a unit from the at least a portion of the group-segregated outdoor space for the at least one b unit.

The at least a portion of said group-segregated outdoor space for the at least one b unit may comprise at least one walk.

In accordance with further embodiments of the present invention, a structure and its adjacent group-segregated outdoor spaces, where the structure comprises at least one a unit and at least one b unit; the group-segregated outdoor spaces adjacent to the structure are physically separated into a first group-segregated outdoor space and a second group-segregated outdoor space for the at least one a unit and the at least one b unit; the areas adjacent to the two or more structures are physically separated by a barrier; and whereby the barrier at least partly limits visibility and access between the first and second segregated outdoor areas; the first group-segregated outdoor space is associated with the at least one a unit; the second group-segregated outdoor space is associated with the at least one b unit; the at least one a unit and the at least one b unit share the same structure in a way that at least a portion of the at least one group b unit is disposed above or below at least a portion of the at least one a unit; the at least one a unit occupies most or all of a first floor space; and the at least one a unit or the at least one b unit has an emergency use exit that opens into the first group-segregated outdoor space and includes a means of monitoring or discouraging use of the emergency use exit.

DESCRIPTION OF THE FIGURES

While the specification concludes with claims particularly pointing out and distinctly claiming the present invention, it is believed that the present invention will be better understood from the following description in conjunction with the accompanying Drawing Figures, in which like reference numerals identify like elements, and wherein:

FIGS. 8A-8C show how louvered exterior stairs prevent views from an elevated height while allowing light in and smoke to ventilate;

FIG. 9 is an embodiment with a balcony and or an egress balcony for group b units as well as a group b segregated abutting outdoor leisure space.

Figure 16A:
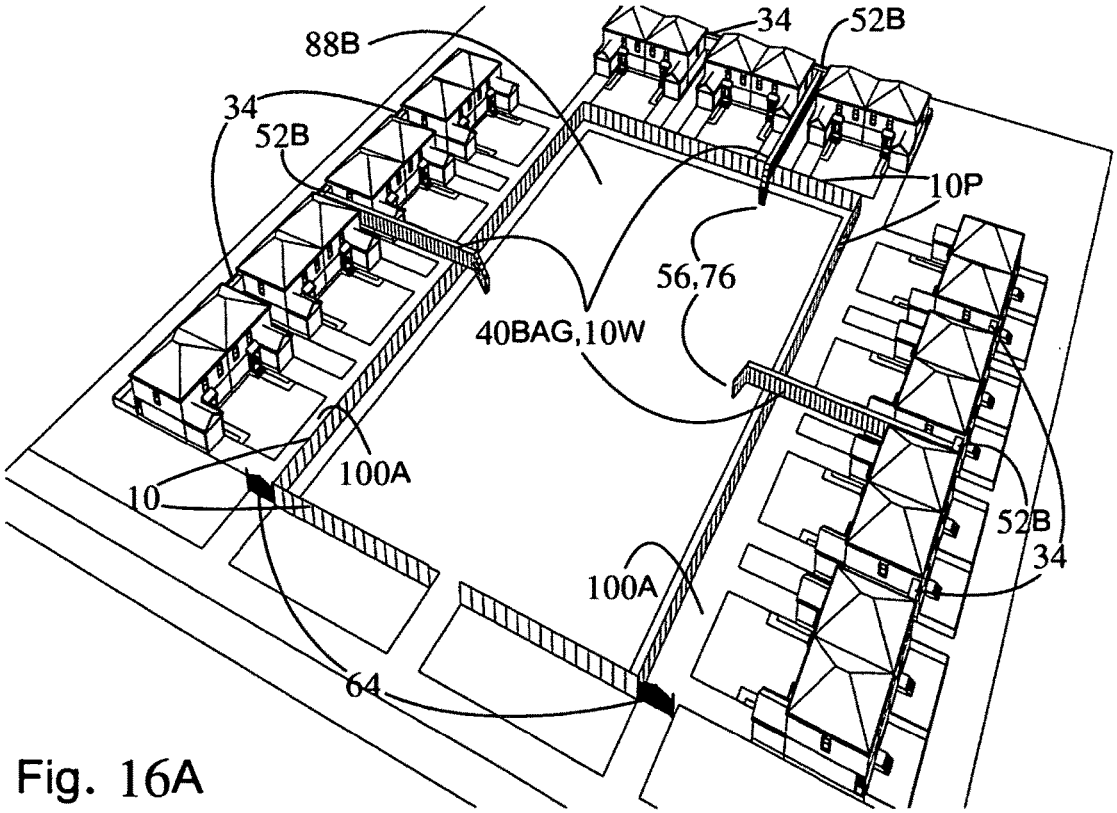
FIG. 16A shows where the group b units parking and or common outdoor space is at the front relative to the group a units perspective; group b units use above grade walks or discharge.

16B is the same as FIG. 16A except that the barrier for group b parking and or common group b outdoor space has been removed to isolate intimate group privacy.

Figure 16B:
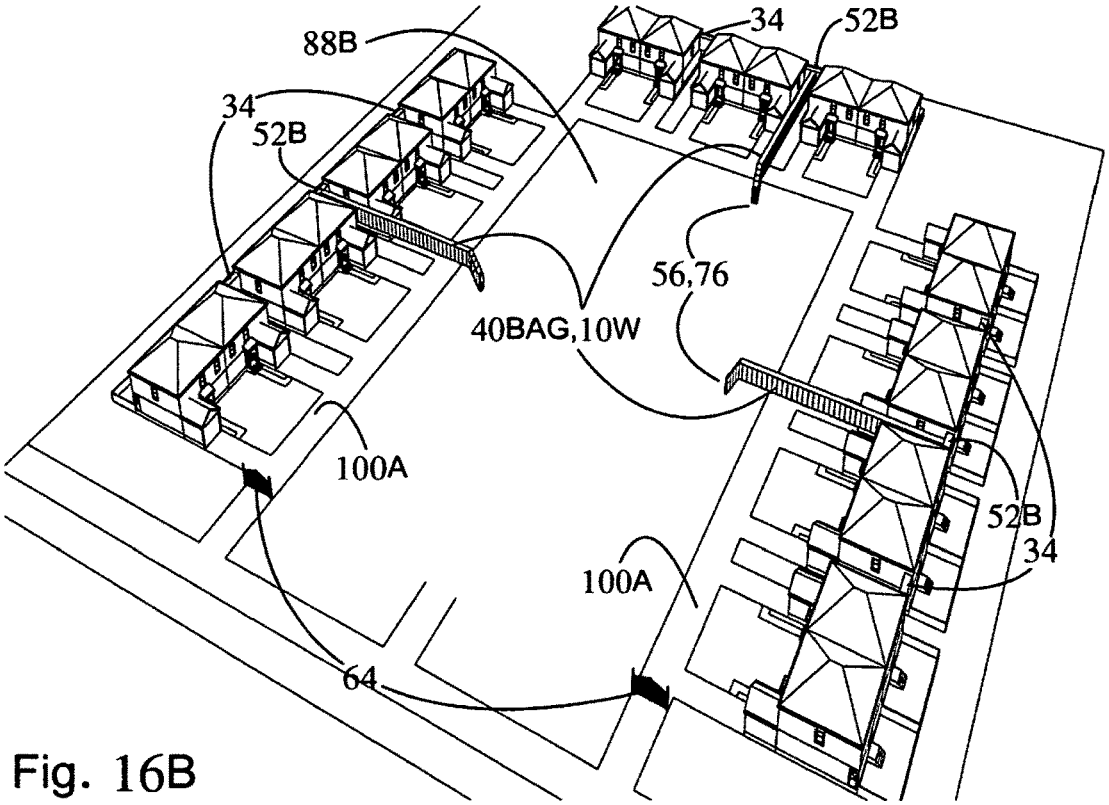
Figure 16C:
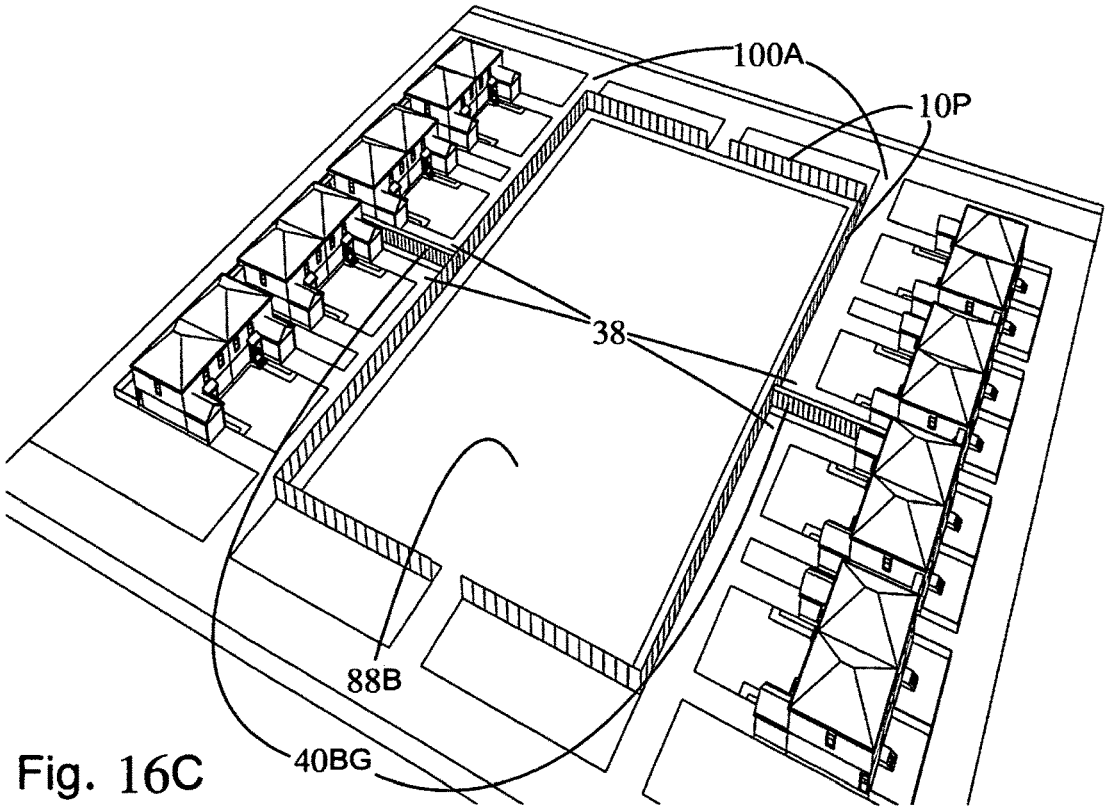
Figure 16D:
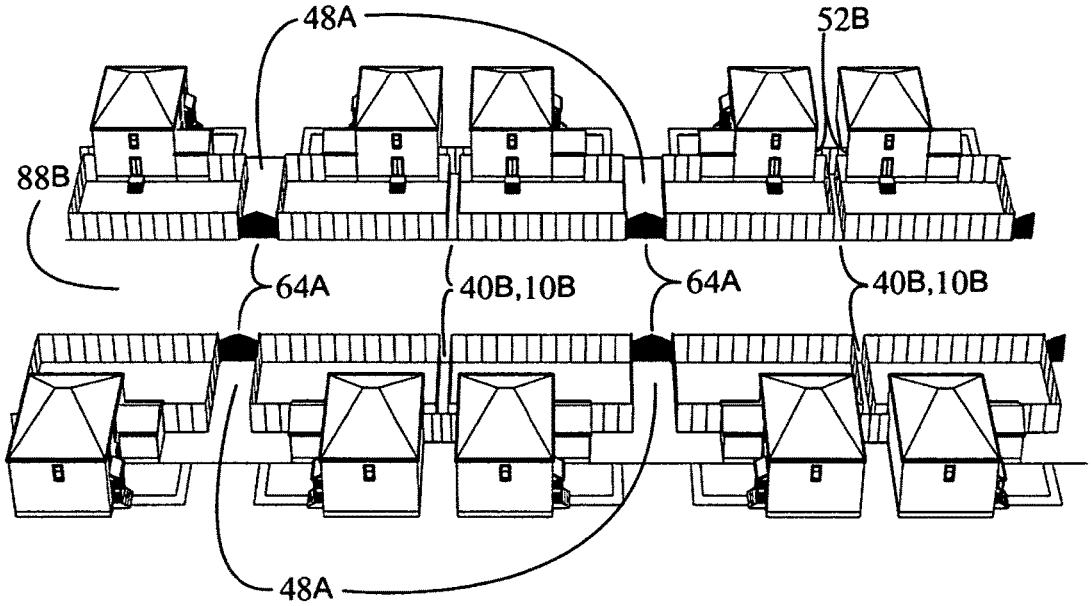
Figure 16E:
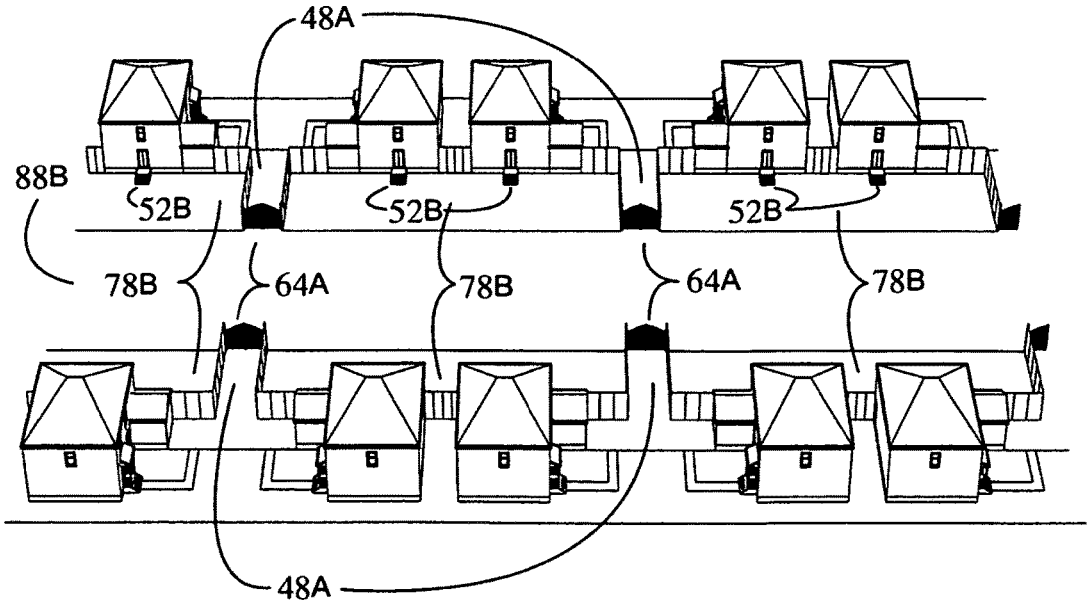
Figure 17A:
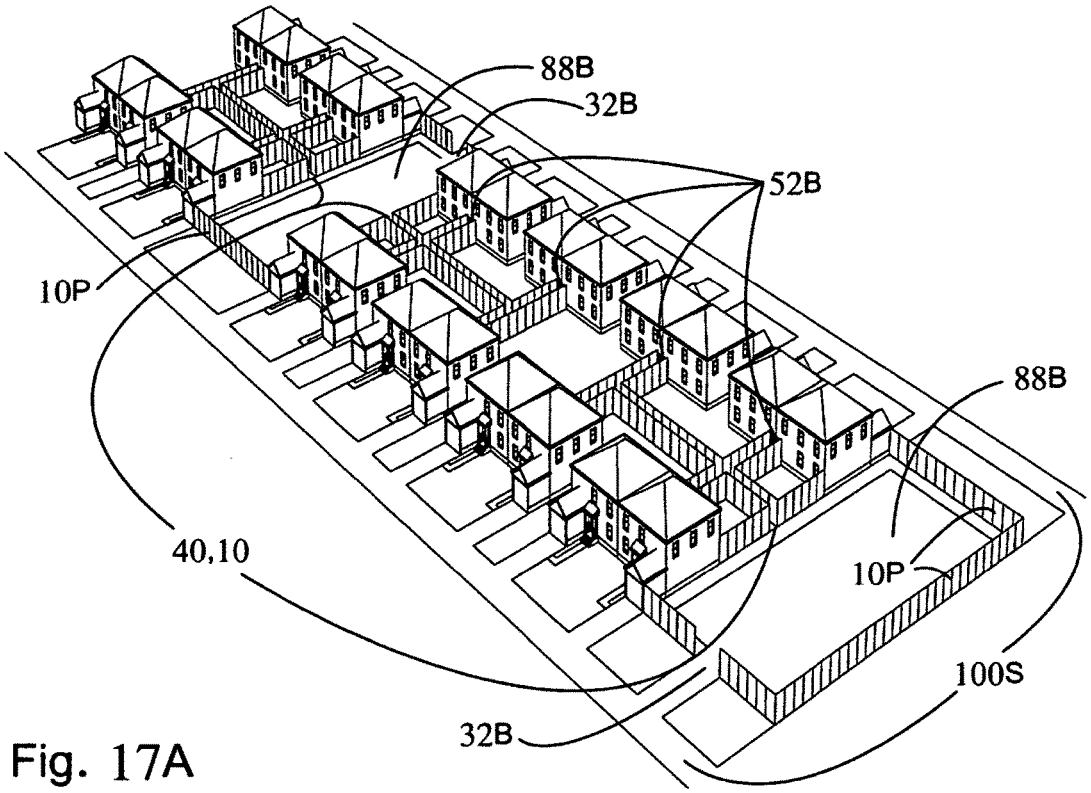
Figure 17B:
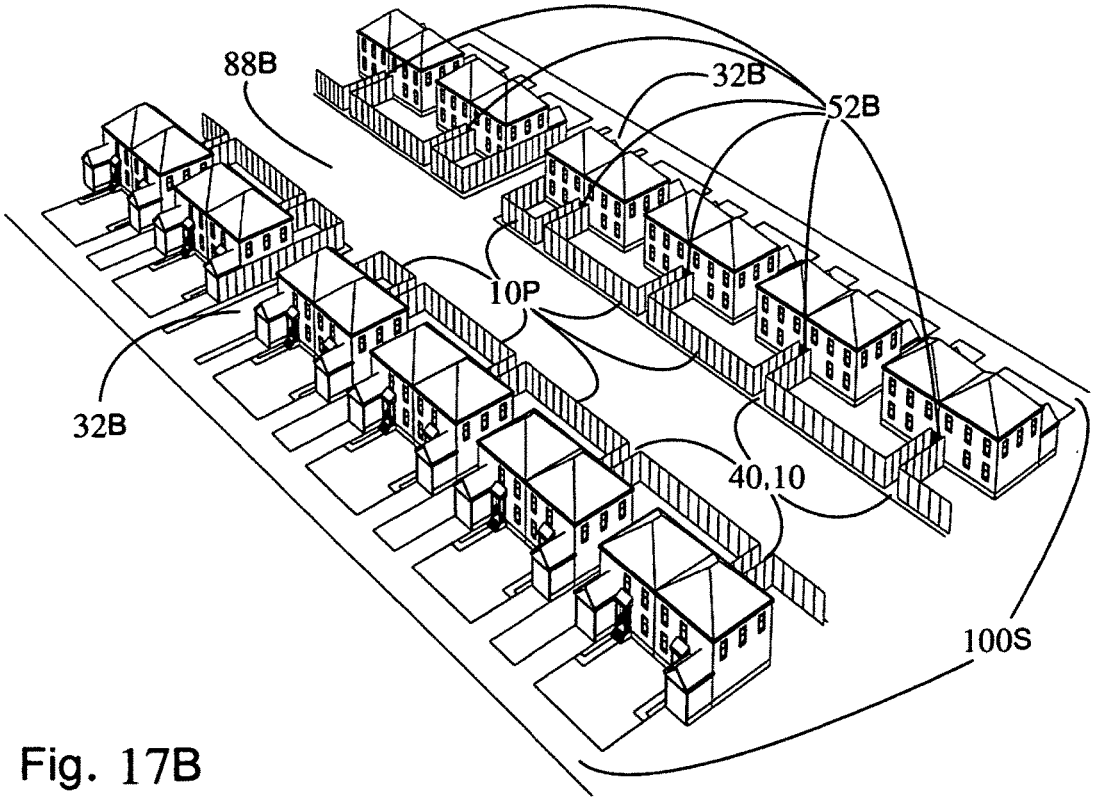
Figure 17C:
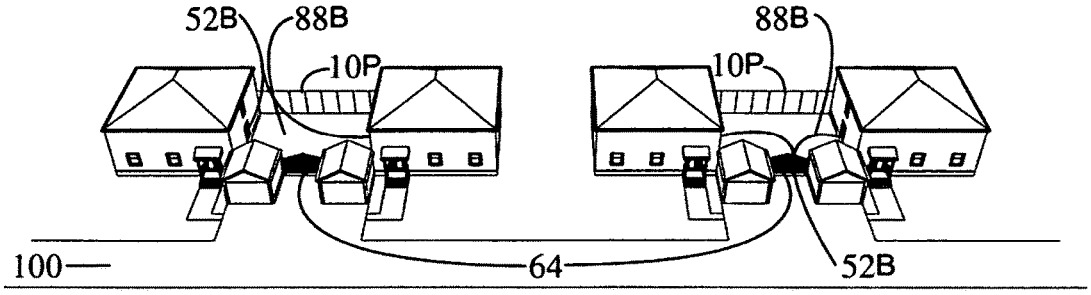
Figure 17D:
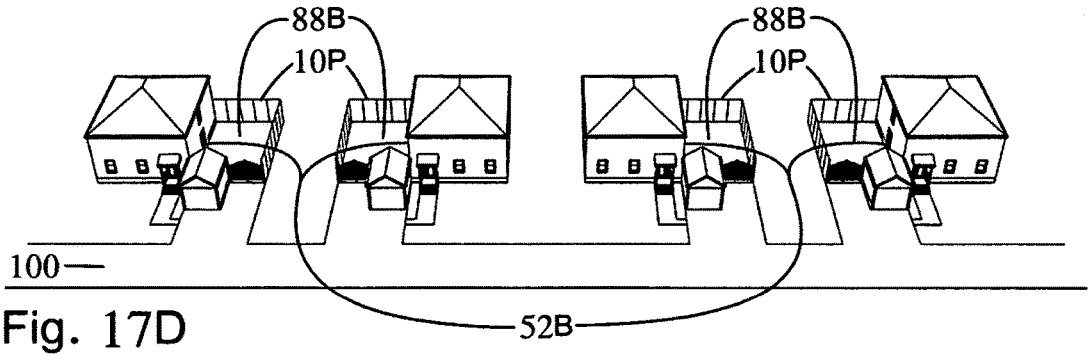
Figure 18:
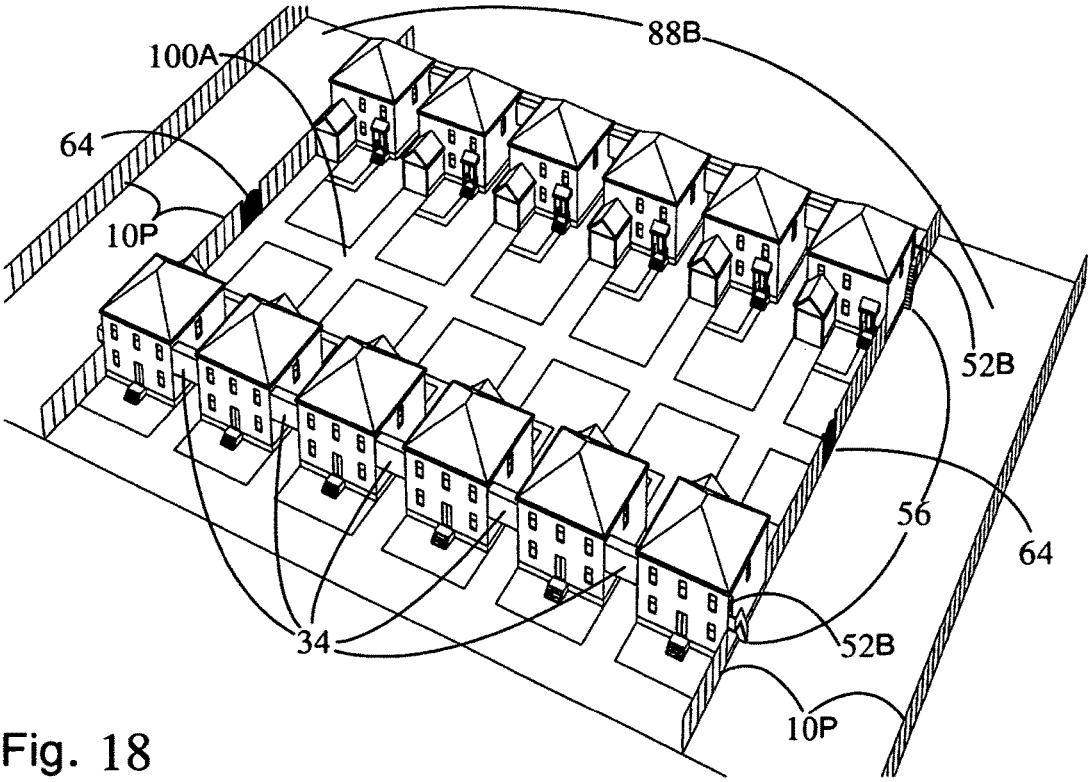
Figure 19A:
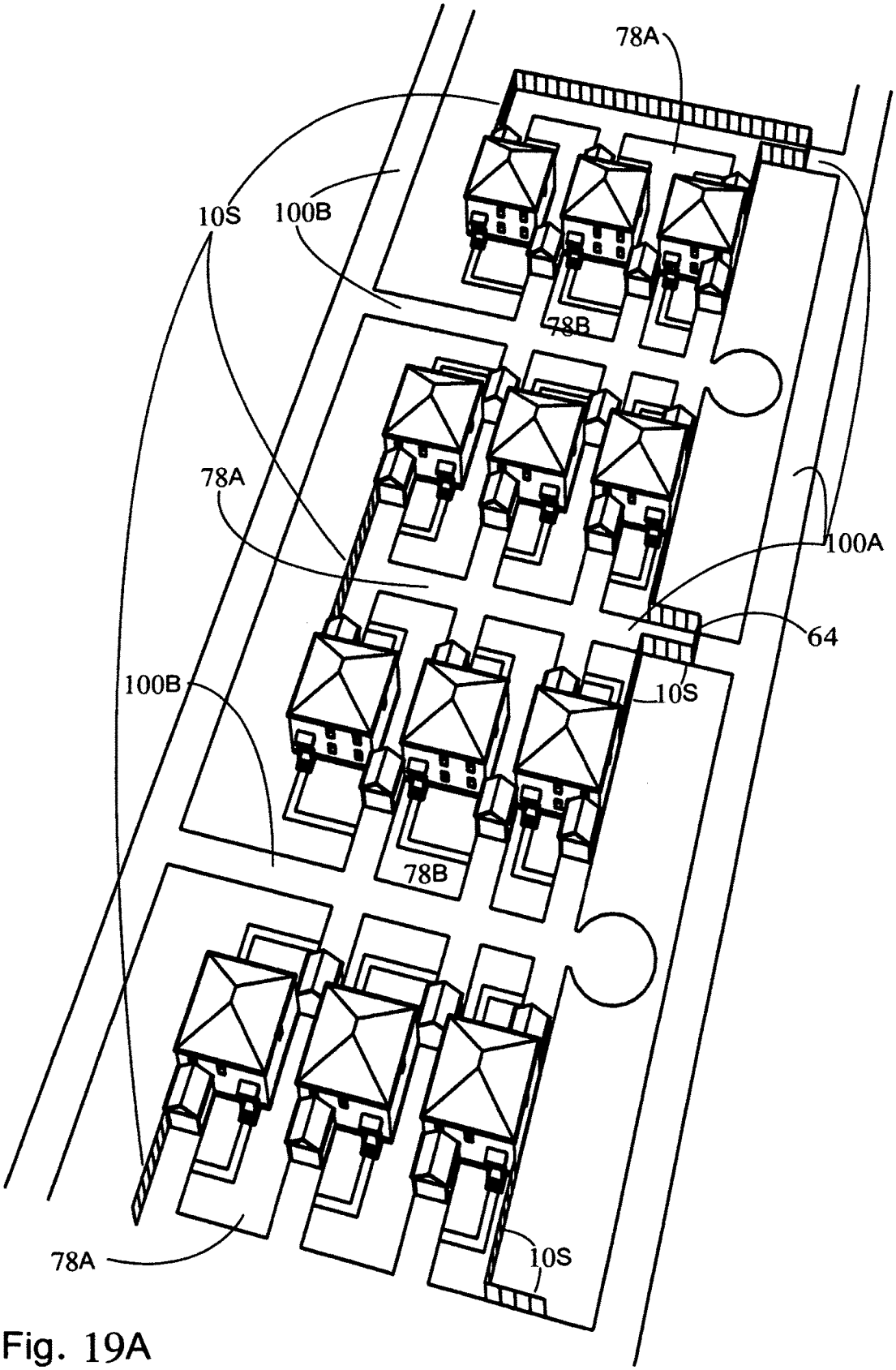
Figure 19B:
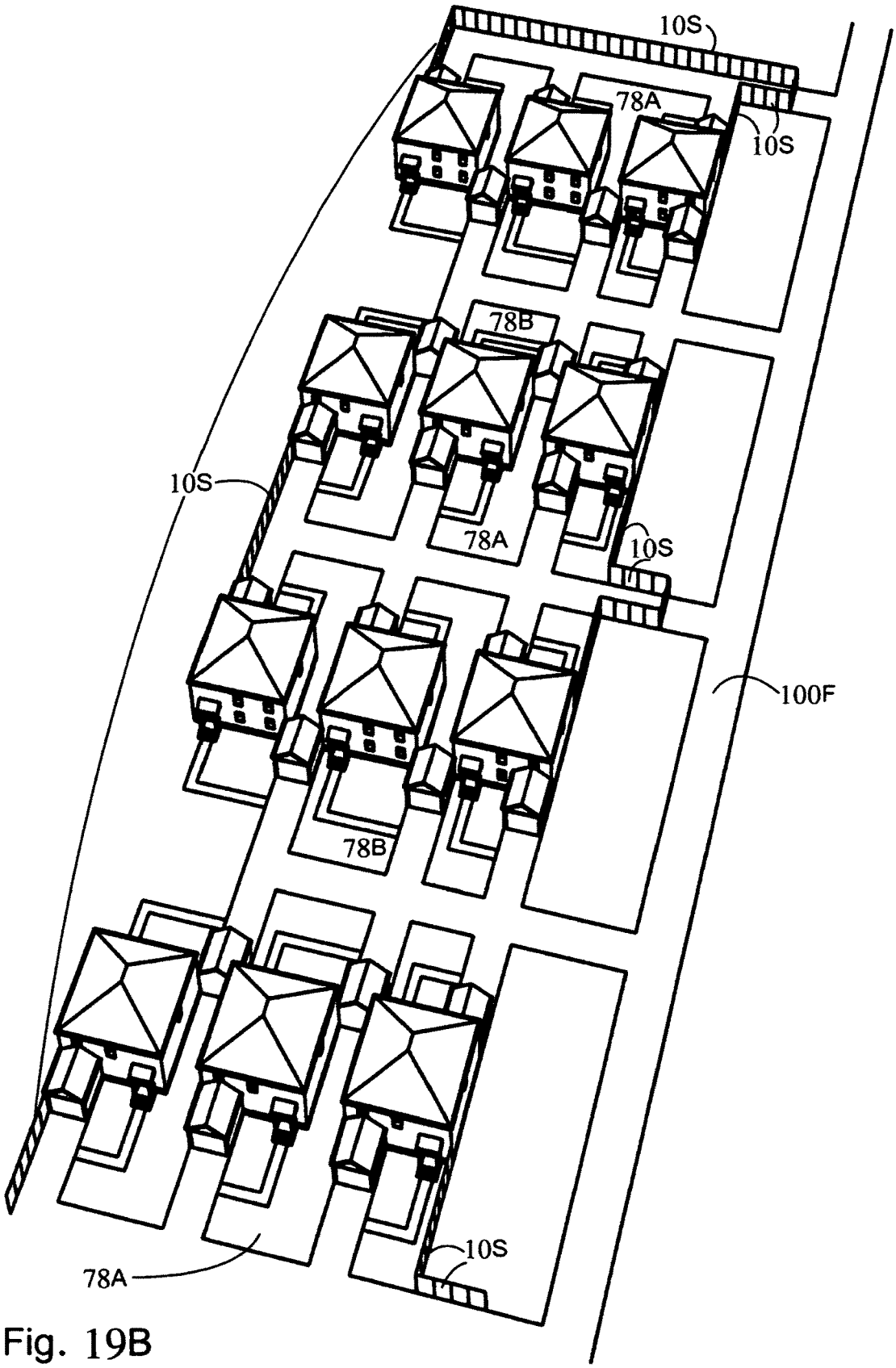
Figure 19C:
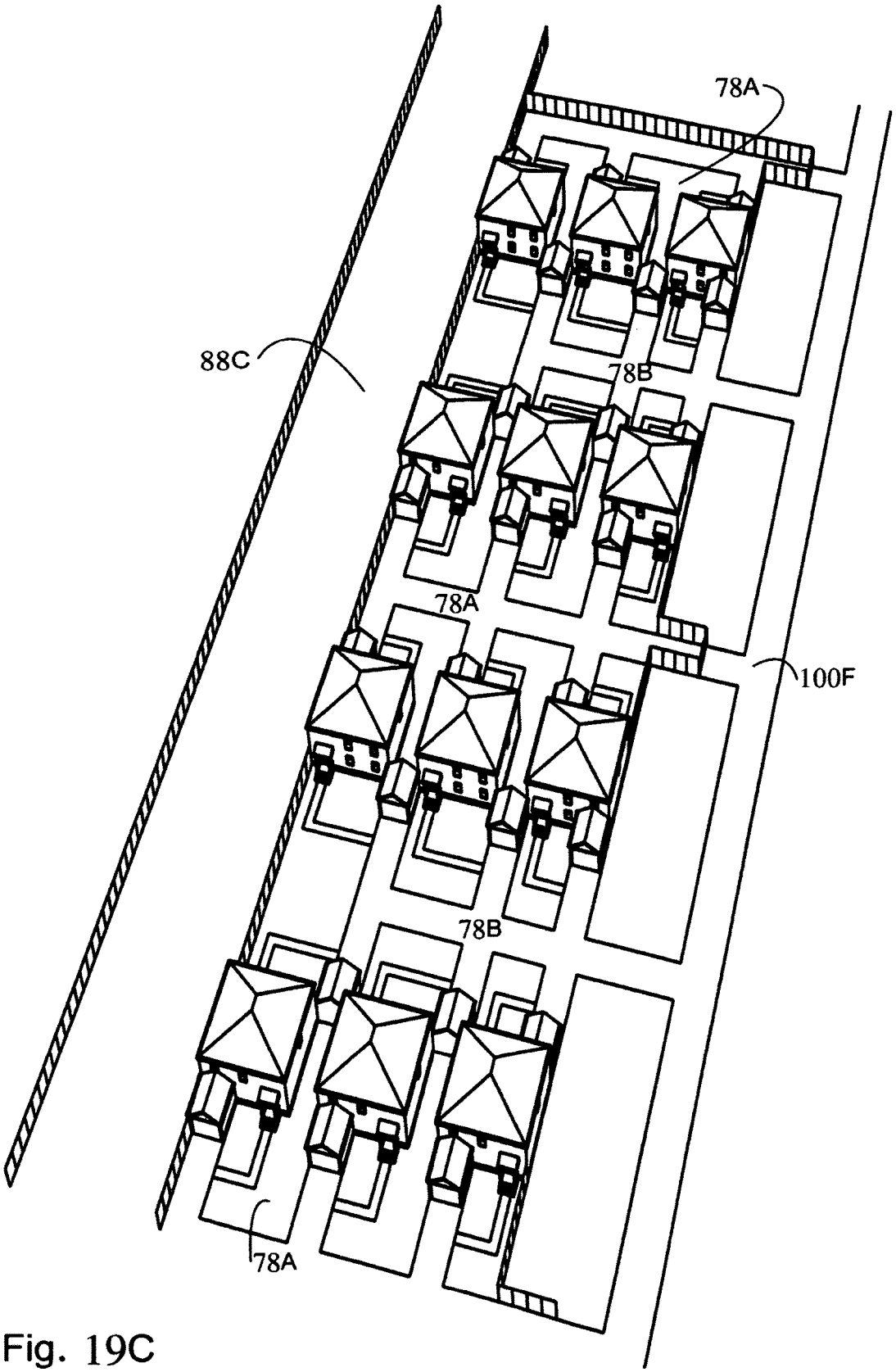
Figure 20:
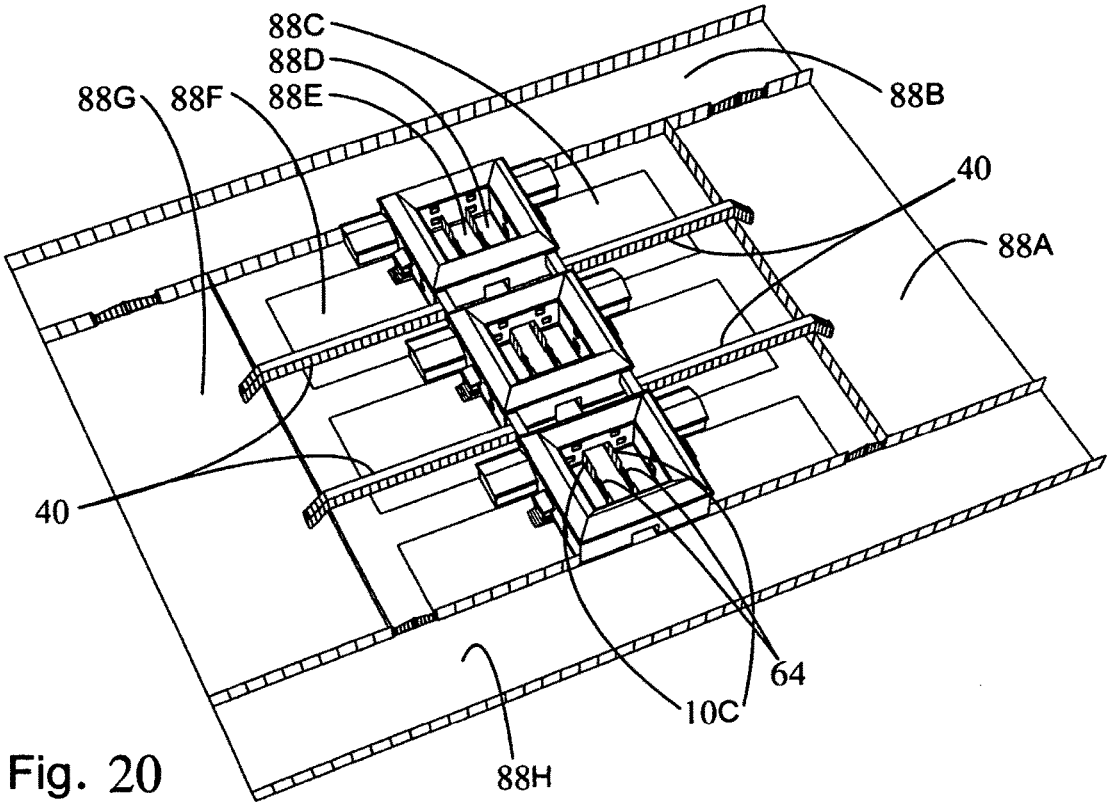
Figure 21:
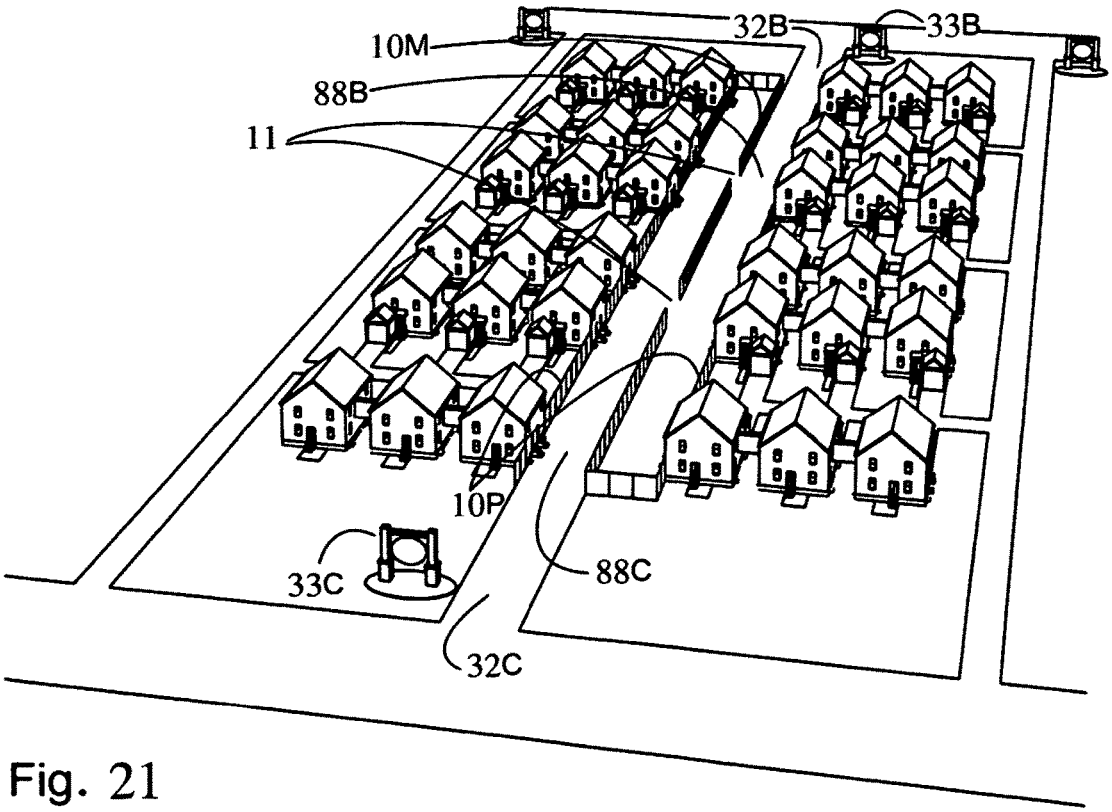
Figure 23:
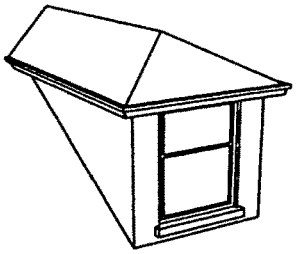
Figure 24:
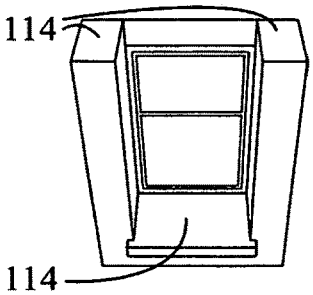
Figure 25A:
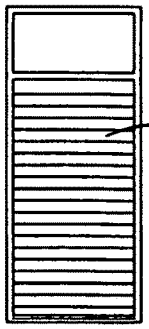
Figure 25B:
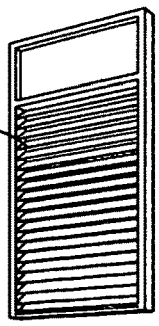
Figure 26A:
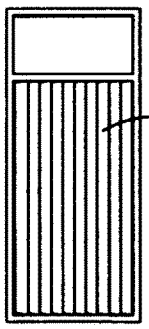
Figure 26B:
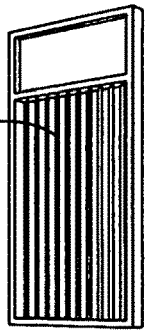

FIG. 16C shows another embodiment where the group b units parking and or common outdoor space is at the front relative to the group a units perspective but here the group b units use walks or discharge that are at grade;

FIG. 16D shows another embodiment where the group b units parking and or common outdoor space is at the front relative to the group a units perspective and the group b units use walks or discharge that are at grade, but here the group a units use the group b units parking and or common outdoor space as their streets;

FIG. 16E is similar to FIG. 16D except that the group b units now also have group segregated abutting outdoor leisure space;

FIG. 17A shows the group b units use the group a units streets to access their parking and or common outdoor space which are broken up into smaller sections and placed at the sides relative to group a units perspective;

FIG. 17B again shows the group b units use the group a units streets to access their parking and or common outdoor space which are now placed at the backs relative to group a units perspective;

FIG. 17C shows the two groups of units again share streets and the group b parking and or common outdoor space or their group segregated abutting outdoor leisure space are between the sides of every other group of two group a units;

FIG. 17D is similar to 17 C except that each building has its own group b parking and or common outdoor space or group segregated abutting outdoor leisure space attached at the side relative to group a units perspective;

FIG. 18 shows where the group a units use the group b parking and or common outdoor space as their streets and the otherwise separate buildings use a corridor to connect the group b units for egress;

FIG. 19A shows each group has their own streets leading to the streets that serve what appears to be a front elevation for each group of units. Each group also has group segregated abutting outdoor leisure space;

FIG. 19B is similar to 19A except that the two groups of units share streets that lead to the streets that serve their front elevations;

FIG. 19C is similar to 19B except that a parking and or common outdoor space has been added to serve a third group of units;

FIG. 20 shows eight parking and or common outdoor space and or group segregated abutting outdoor leisure spaces;

FIG. 21 shows a group a secluded outdoor area and groups b and c semi segregated parking and or common outdoor space that have overflow parking breaks in their barriers;

FIGS. 22A to 22E show various ways windows or dwellings, garages or structures can be placed or arranged to reduce views to the other groups group segregated abutting outdoor leisure space;

FIG. 23 shows how a dormer limits views;

FIG. 24 shows an attached exterior view blocking means for widows;

FIGS. 25A to 25B show fixed horizontal window louvers;

FIGS. 26A to 26B show fixed vertical window louvers; and

Figure 27:
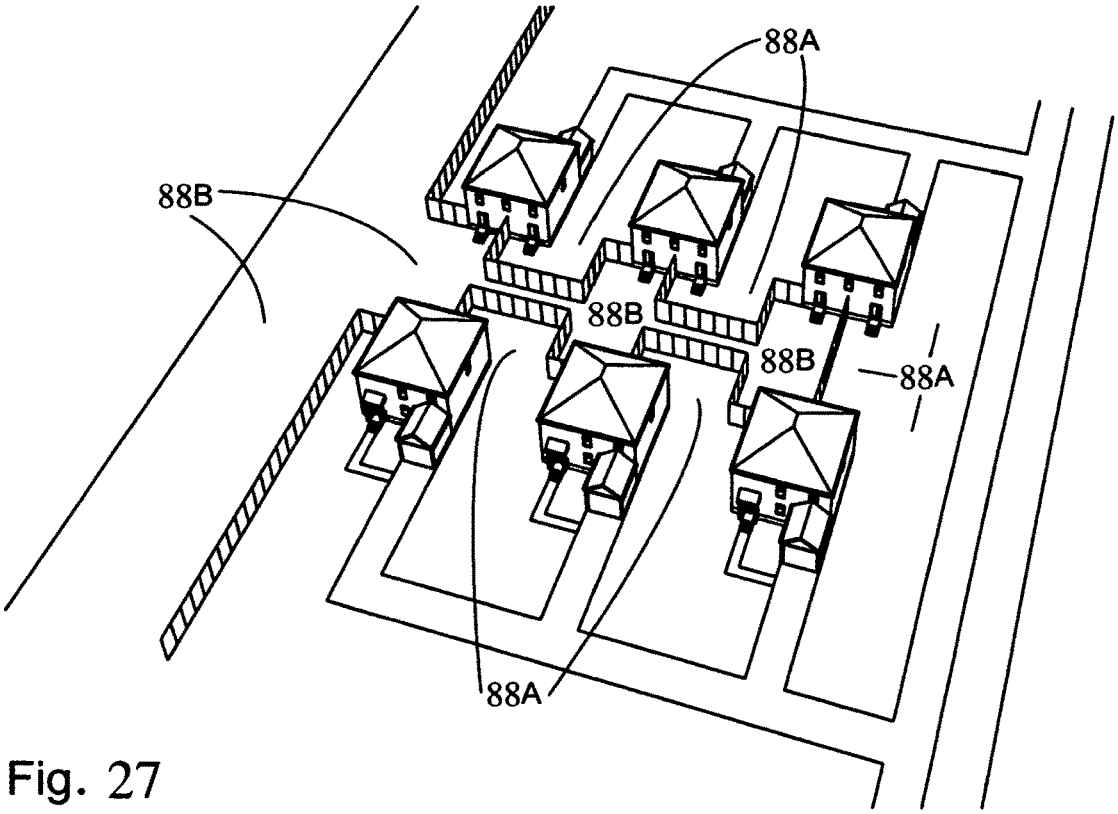

FIG. 27 shows an embodiment where the two groups of units split what appears to be the back yards relative to group a units perspective as group segregated abutting outdoor leisure space.

Figure 28:
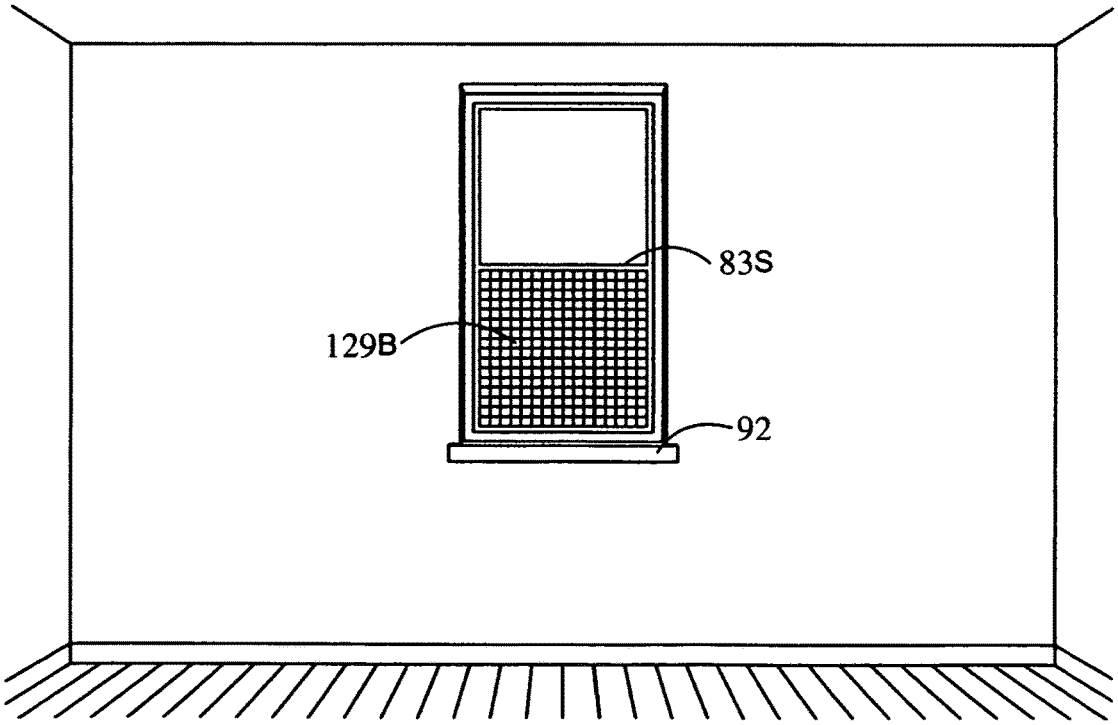

FIG. 28 show a possible bedroom emergency escape and rescue window embodiment.

Figure 29A:
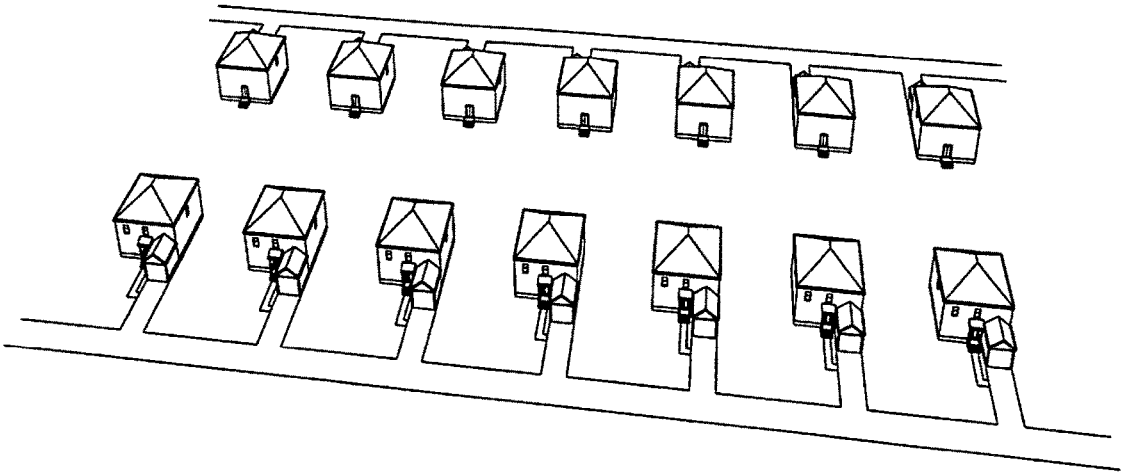

FIG. 29A shows a possible existing community prior to individual building retrofits.

Figure 29B:
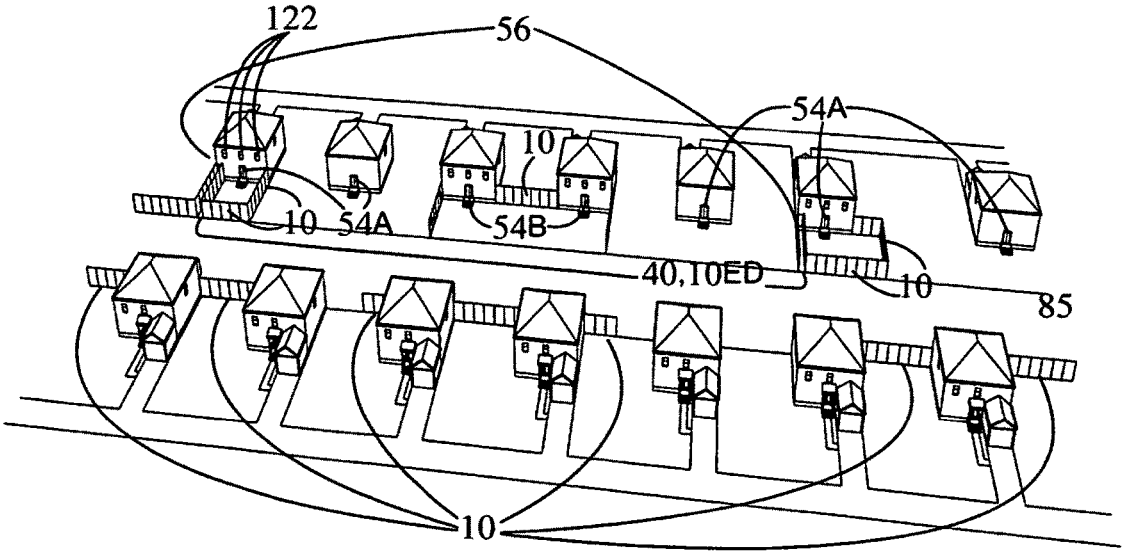

FIG. 29B shows some possible retrofits to FIG. 29A.

DETAILED DESCRIPTION

This application claims priority to Provisional Application No. 61/957,612 filed Jul. 8, 2013, which is incorporated by reference in its entirety.

Figure 1A:
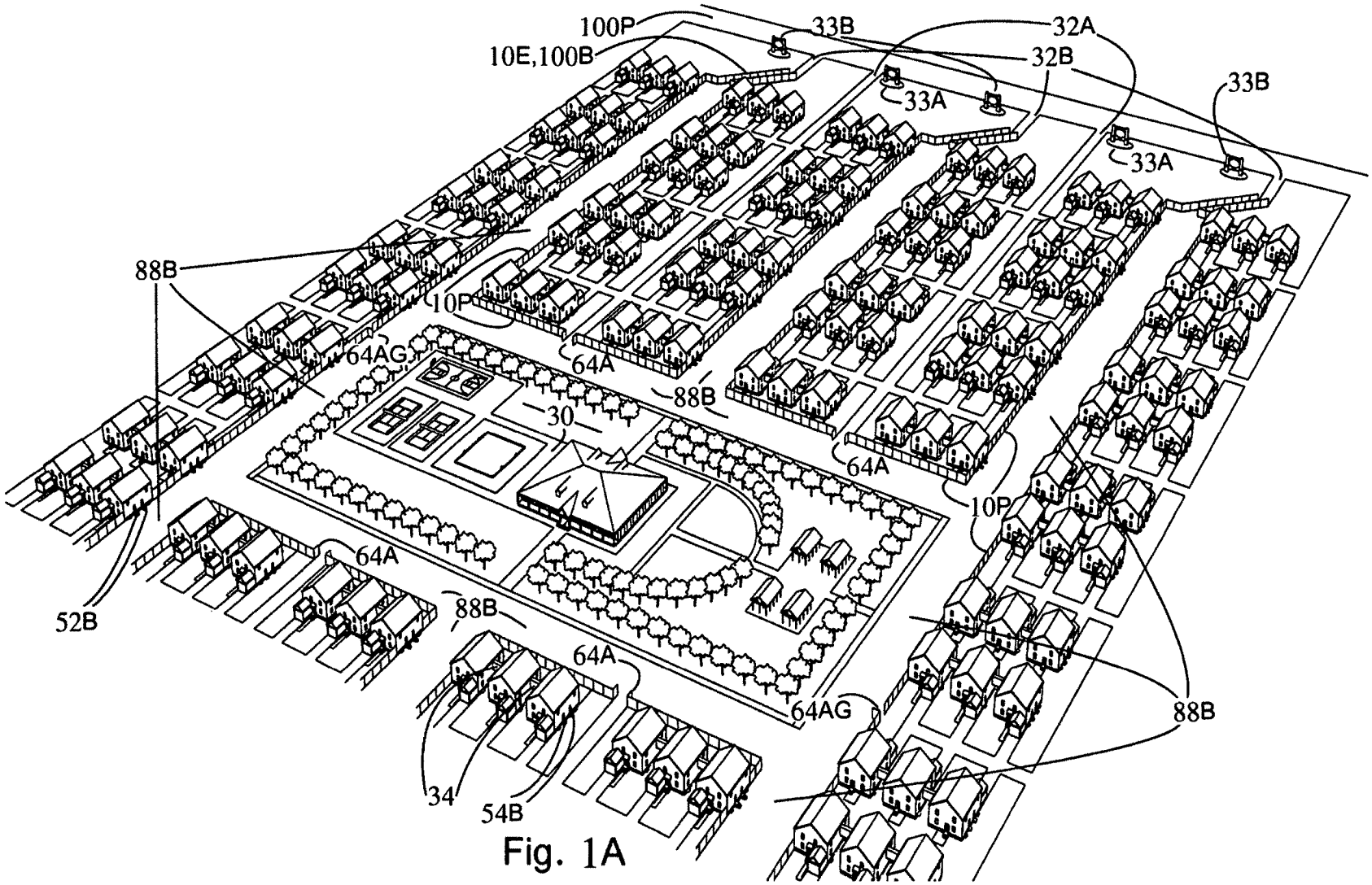
FIG. 1A shows an overall view of one embodiment of a community of buildings in accordance with the present invention where group b units have a parking and or common outdoor space that is oriented to the side relative to group a units perspective.

Reference is now made to FIGS. 1A, 1B, 1C 2A, 2B, 3A, 3B, and 3C. In accordance with a preferred embodiment of the present invention as illustrated in FIG. 1A, the building or buildings of the preferred embodiment include an existing building or buildings and communities that are retrofitted with privacy features or new construction buildings and communities with privacy features designed and built in from the start. The buildings or dwellings of this embodiment consist of two above grade stories and one below grade story but could be three or more stories above grade and two or more below grade. The buildings have two groups of units that function in different ways. In this embodiment the ground floor or first floor consists entirely of group a units but can contain complete or partial group b units. In this embodiment the second story and below grade levels contain only group b units but could contain complete or partial group a units. Group a units function as single family homes and group b units function as apartments.

The buildings shown in the preferred embodiment of the present invention are grouped in threes; however, any number of building groupings or quantity of floors is contemplated by the preferred embodiment of the present invention. The second story, or group b units, of each series of three dwellings are connected by a corridor (34). The below grade group b units are connected by an underground corridor in the same manner. The second story and below grade units, or group b units, of each series of three buildings each have one standard use exit (52B). There could be more than one standard exit per floor. The group b standard use exits only exit, or discharge, to a group b parking and or common outdoor space (88B). This group b parking and or common outdoor space is completely enclosed by one or more partitions, or, as shown in FIGS. 1-3 of the preferred embodiment, a combination of the dwellings and a non see through and non pass through barrier (10P) such as a fence, wall, landscaping or structures such as garages, carports or storage buildings. The group b units of the preferred embodiment of the present invention may be occupied or used by a renter, or an entity holding a leasehold estate in the group b portion of the buildings. However, the group b units, as a group or individually, may be occupied, owned, or both by a separate owner, the same owner as occupants in group a, or any other entity having any type of property estate or utilizing the property for any dwelling or business purpose.

The group b group b parking and or common outdoor space has community entrances (32B) and community entrance signs (33B) specific to their paring and or outdoor common outdoor space. The group b units' community entrance signs have a community name and possibly other identifying attachments specific to the group b units' entrance signs. In the preferred embodiment of the present invention, the entrances have an angled section of street (100B) and a barrier (10E) to prevent views from the public street (100P). The group b parking and or common outdoor space provides unobstructed access to the clubhouse and amenities (30).

In the preferred embodiment the group b units have one emergency use only exit from each level (54B). This emergency exit discharges to a group a group segregated abutting outdoor leisure space. This exit may have a monitoring means to monitor if it is opened. It may have an alarm sound if opened. It may also have a sign posted warning to open only in case of emergency. Because this is an emergency use only exit, the group b units have no normal means to access any outdoor area other than the group b parking and or common outdoor space (88B).

The remaining outdoor space that does not serve the group b units is group a group segregated abutting outdoor leisure space, which is separated from the group b parking and or common outdoor space by at least one partition or barrier such as a fence, a building, etc. In the preferred embodiment the group a group segregated abutting outdoor leisure space includes the yard(s) that are attached to the dwelling(s) and the group a unit streets, sidewalks, mailboxes and everything that might be found in the yards and community of private homes. In this embodiment the group a units are the only units that have normal non emergency means to access the group a secluded outdoor areas. In the preferred embodiment the group a units are the only units that have access to the yards attached to the dwellings. The means to access the yards can include front, back or side doors, sliding doors or any other means to access the yards around their dwellings. Other embodiments will show where group b units also have group segregated abutting outdoor leisure space.

In the preferred embodiment of the present invention, the group a group segregated abutting outdoor leisure spaces have community entrances (32A) and community entrance signs (33A). In this embodiment, each of the group a entrances identified are also segregated from each other. Other embodiments could allow each entrance to a group a group segregated abutting outdoor leisure space be an entrance to a group segregated abutting outdoor leisure space that serves a different group of units. These different groups could be retirement communities, retirement facilities, over 50 years of age communities, communities that encourage occupancy by young families, or unrestricted communities among countless others. The signs have a community name and possibly other attachments specific to the group a units' entrance signs. There is a clubhouse and amenities (30) that are part of the group b parking and or common outdoor space. These amenities could be shared with group a occupants. The group a group segregated abutting outdoor spaces may have street gates (64A) to access the clubhouse and amenities by car or on foot, as shown in the FIG. 1A. Other group a units may be able to access the clubhouse and amenities with a walk through gate (64AG).

Figure 1B:
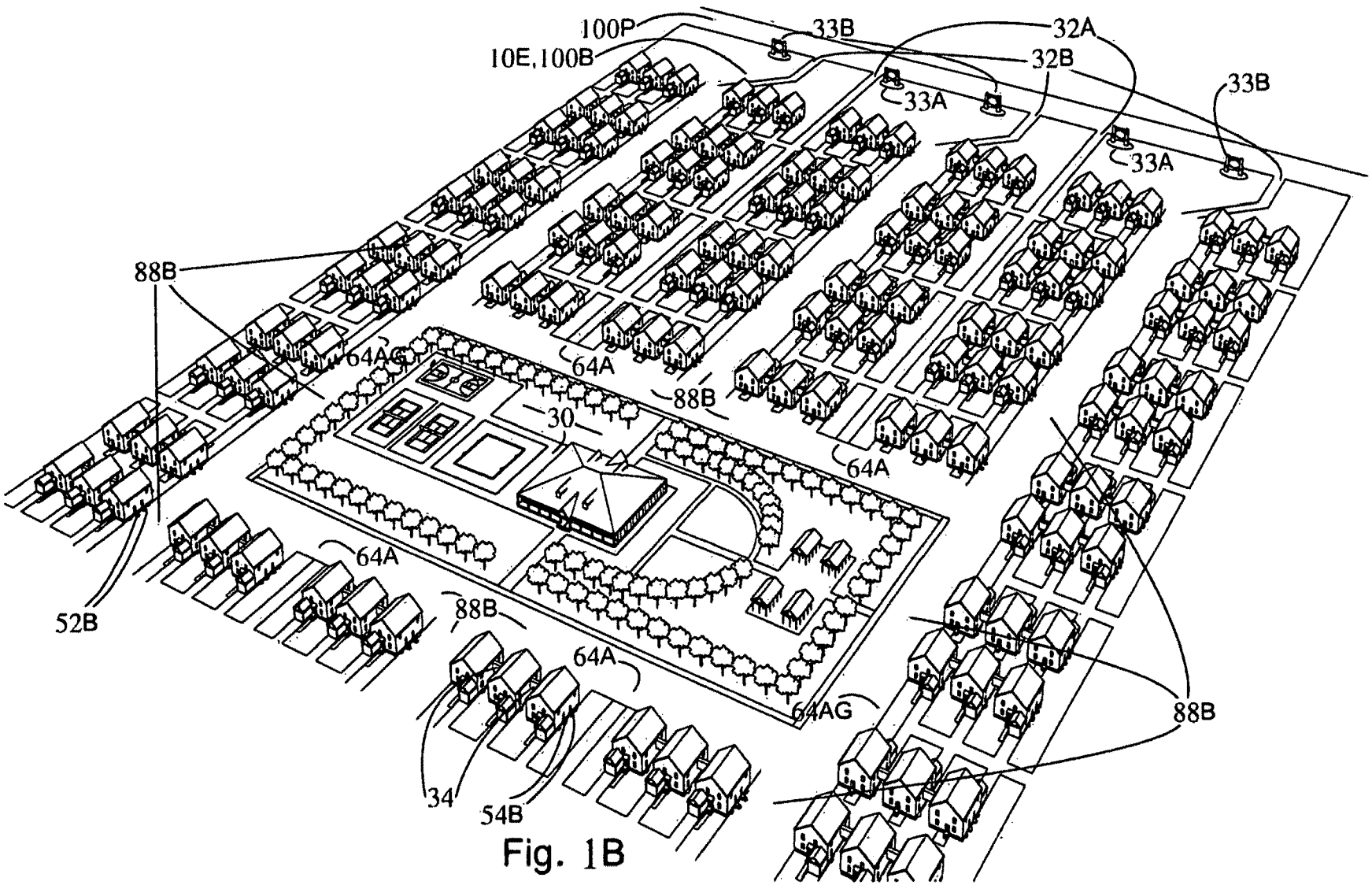
FIG. 1B is the same as FIG. 1A except that the barrier for group b parking and or common group b outdoor space has been removed to isolate intimate group privacy.

FIG. 1B is the same as FIG. 1A except that the barrier from FIG. 1A (10P) has been removed. This is to show that even without the barrier (10P) significant privacy between the groups is achieved at the areas closest to the group a units—that is the group segregated abutting outdoor leisure space. In this embodiment the element that provides the group privacy in the most intimate space of the group a units is the means of egress, namely the corridor (34). This corridor that connects the group b units and leads them all over or under the group a group segregated abutting outdoor leisure space provides possibly a more intimate segregation of the two groups than does the barrier between the group b parking and or common outdoor space. As will be shown in other FIGS. and embodiments, other group privacy innovations will further improve privacy at this most intimate part of the group a group segregated abutting outdoor leisure space. These other group privacy elements will be shown to provide independent means to greatly enhance privacy between the occupants of two groups of units who inhabit the same group of dwellings.

Figure 1C:
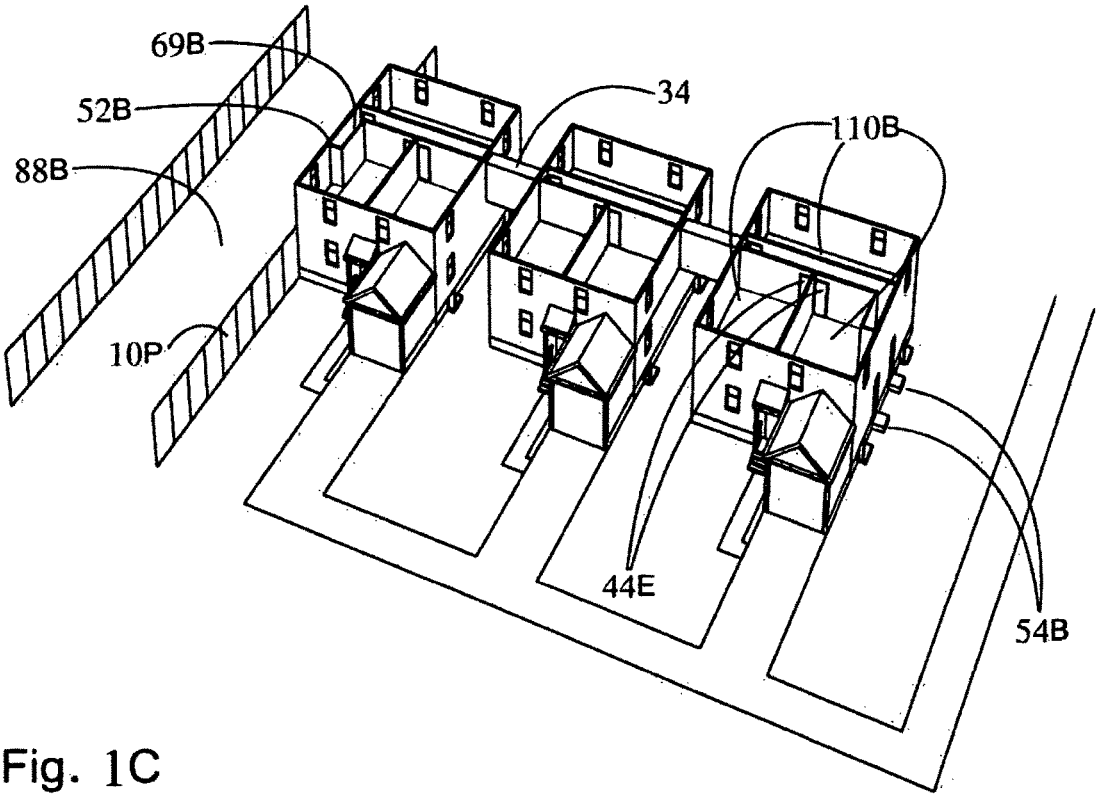
FIG. 1C shows an isolated view of a series of three buildings of FIG. 1B with their roofs removed.

FIG. 1C is a section of FIG. 1A with the roof removed to show the second story group b units (110B) and group b apartment egress. In this embodiment each building has three group b units on the second floor. The group b units each have an exit access door (44E) that provides access to a corridor (34). The corridor connects the otherwise separate buildings. The corridor leads all units to interior stairs (69B) which lead to the main exit door (52B not shown) for group b units which is located near grade. The exit door exits or discharges into the group b parking and or common outdoor space (88B).

The below grade units are laid out in a similar manner with a below grade corridor extending between the buildings to connect the below grade group b units and cause them to exit to the group b parking and or common outdoor space in a similar way that the second story egress system serves this function. The means by which group a does not see or encounter occupants of group b could be by any means. What is important is that the group b normal use exit door does not discharge into a group a group segregated abutting outdoor space in a way that the two groups are likely to see or encounter each other. There is a second group b exit (54B) for each floor that is intended for emergency use only as these exits open into a group a group segregated abutting outdoor leisure space. This emergency use exit could be equipped with any means to discourage its use except for emergencies.

FIG. 2A—Windows

Figure 2A:
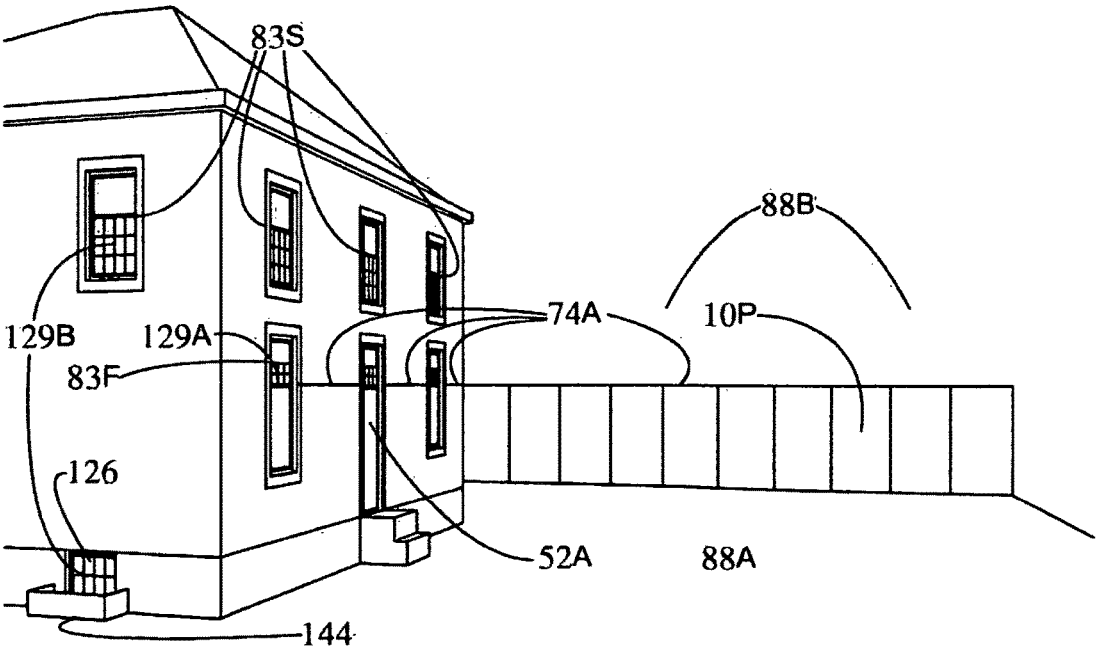
FIG. 2A shows one embodiment of window issues and possible solutions.

FIG. 2A shows one embodiment of exterior windows for both group a and group b units. This is a view of the back and a partial view of one side of the exterior of a building relative to the orientation of the group a units' perspective. In this embodiment all group a units are located on the first floor and all group b units are on the second floor and the below grade floor. All of the grounds shown in this view (88A) are part of the group a units' group segregated abutting outdoor leisure space. A barrier (10P) provides visual and physical privacy between the group a units' group segregated abutting outdoor leisure space and the group b units parking and or common outdoor space (88B). Beyond the barrier is the group b parking and or common outdoor space (88B). The first floor windows and door (52A) belong to group a units.

First Floor Group a Unit Windows

A height at which someone inside the first floor group a units would look out the windows and have a line of sight directly over the barrier (10P) is shown as (74A). A person of normal height in a standing position could not see out the window in a downward direction at this line of sight (74A).

The maximum estimated occupant standing eye height when standing in a group a unit is shown as (83F). At this height they could see over the barrier (10P) in a downward direction into the group b secluded outdoor area (88B).

Distorted view glass, which is also known as obscure glass, glass block or another transparent material including polymers, is indicated by (129A). This material allows light to flow into the units but does not allow for a clear view out of the window. In this embodiment the distorted view material is installed from the point just at which a view is possible in a downward direction (74A) over the barrier up to the maximum estimated occupant standing eye height (83F).

Second Floor Group b Unit Windows

In this embodiment the group b units are built into the second floors and below grade floors. The maximum estimated occupant standing eye height when standing in an above grade group b unit is indicated by (83S). (129B) indicates distorted view glass or other material that allows light to flow into the units but does not allow for a clear view out of the window. In this embodiment the distorted view material is installed from the point at which a view is possible by an occupant standing in a group b second story unit in a downward direction (83S) and down to the group a units group segregated abutting outdoor leisure space (88A).

A below grade window belonging to a group b unit is indicated by (126). This part of the window uses distorted view material (129B) that allows light to flow into the unit but does not allow for a clear view out of the window. This window could serve as a bedroom emergency escape and rescue window. A window well (144) could be a normal window well or a code acceptable bedroom emergency escape and rescue window well. The window well could have a distorted view cover.

FIG. 2B—Grading

Figure 2B:
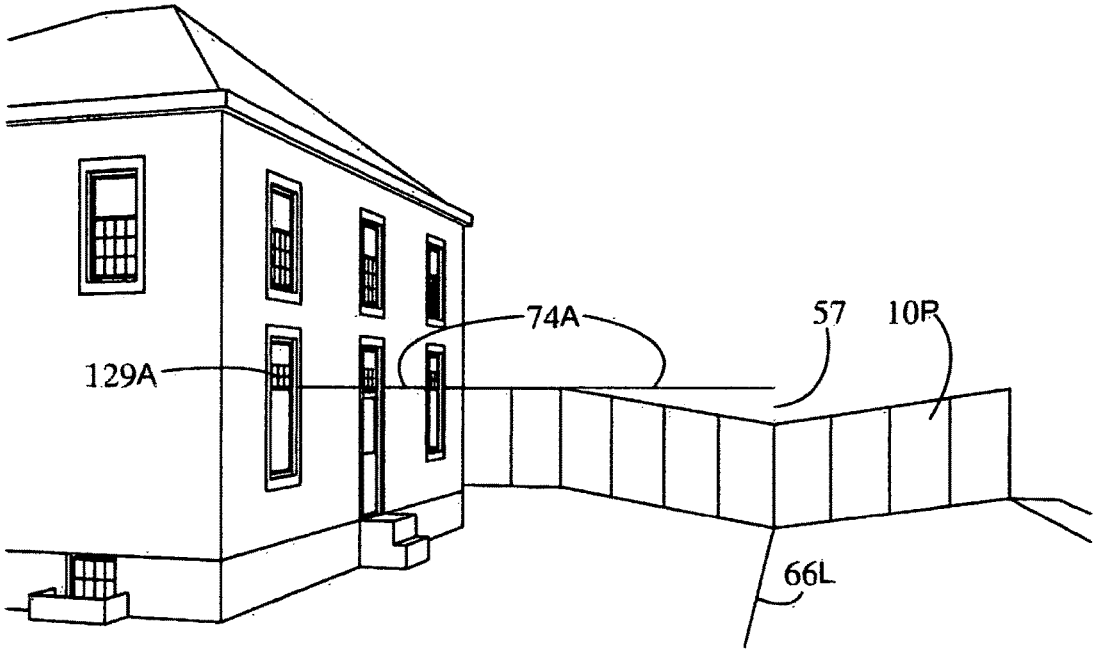
FIG. 2B shows how the window issues discussed in FIG. 2A can change due to grading and drainage issues.

FIG. 2B shows the same dwelling, windows and doors as FIG. 2A with a grading and drainage plan that does not maximize the height of the barrier (10P). The low point of the grading and drainage plan is (66L). This causes the barrier to drop by the same distance as the fall in the grade (57). The line of sight (74A) from inside the first floor group a units now will allow a person to look over the barrier in a downward direction due to this fall in grade and subsequent fall in the barrier. If the barrier is built along this grade, the line of sight (57) is lower by the same amount the barrier falls with the grade (57). To prevent a view over the barrier in a downward direction the distorted view window material (129A) may be extended down by the same distance as the fall in the grade at the barrier (57). The grading and drainage plan could be designed to minimize this problem and maximize the visual blocking of the barrier.

Figures 3A, 3B, 3C:
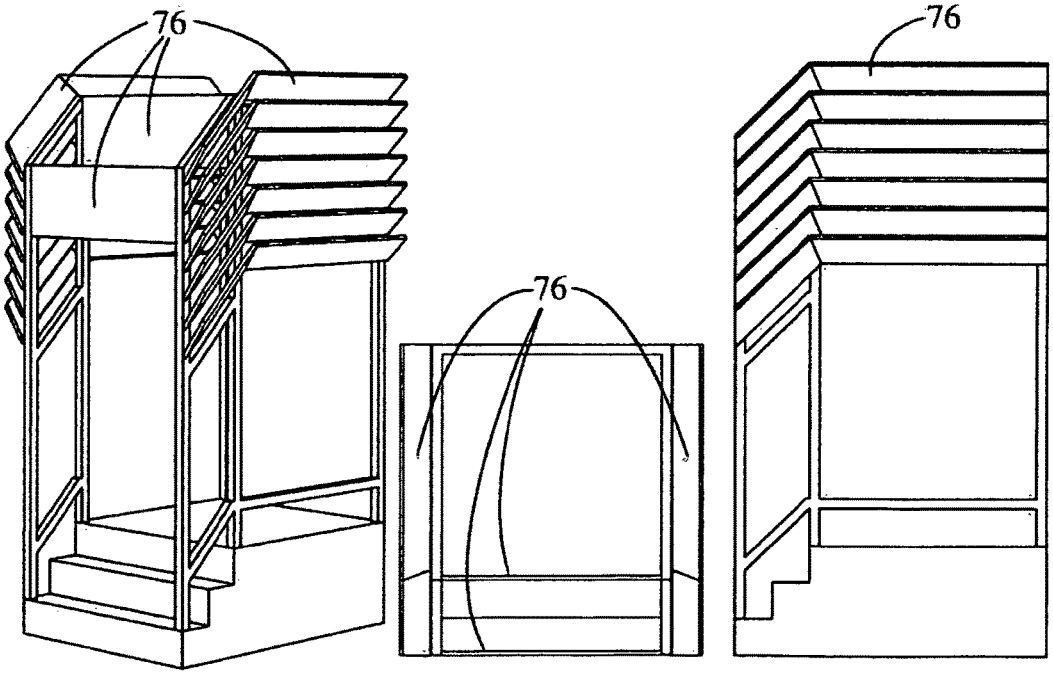
FIGS. 3A-3C show louvers used to limit views from an elevated landing or other elevation that would otherwise provide a view that is deemed undesirable for group privacy.

FIGS. 3A, 3B, 3C Louvered or Enclosed Landings.

Exits from dwellings are typically above the natural grade by one to three feet or more. This elevated height could provide a view over a barrier. FIG. 3A shows an elevated group b exit landing pad that is treated with louvers (76). FIG. 3B is a top down view and FIG. 3C is a side view. This arrangement allows light and air to flow in without allowing views from the elevated landing pad and over a barrier to a group segregated abutting outdoor leisure space of the other group of units. This may also help in meeting building and fire codes. This arrangement or a similar arrangement can be used on any embodiment where group b has an elevated outdoor area that would otherwise have a view to a group a units' group segregated abutting outdoor leisure space or group a void. Instead of louvers, any view blocking means could be used including a complete or partial enclosure. To block the view, additional structure beyond a roof may be added as the roof may only block views in an upward direction. In the preferred embodiment shown, the louver embodiment has no roof as it is may not be required to achieve privacy and may help to comply with building and fire codes.

Group Privacy Building Configurations enable two or more groups of people to inhabit the same group of dwellings in a way that they are less likely to see or encounter members who occupy the opposite group of units. Two groups of people who typically inhabit separate communities can both inhabit these buildings and be less aware of the other group of units and their occupants than any other real estate design of its kind. In this embodiment there are two groups of units. One group of units operate like single family homes and the other group of units operate like apartments.

In this embodiment the buildings and community are built so that the two occupant groups can inhabit the same buildings and be unlikely to see or encounter members of the other group anywhere inside, outside or throughout the hybrid community. This near complete isolation is not mandatory but is displayed here to give a more complete example of Group Privacy Building Configurations. However, this first embodiment only shows some features of Group Privacy Building Configurations. In the following operation description the homeowners inhabit the first floor of each building and are called group a units. The apartment units occupy second floor and below grade space and are called group b units, but this is not required. The two groups of units could house any two groups of people such as retirement community occupants and office occupants, among many others.

The group a units are shown with a group segregated abutting outdoor leisure space. The group b units are sometimes shown with a group segregated abutting outdoor leisure space and usually shown with a parking and or common outdoor space. This parking and or common outdoor space is usually shown with a barrier, but this barrier is not required to create significant improvements in group privacy. As shown in FIG. 1A, group b's parking and or common outdoor space (88B) is located at the side relative to what appears to be the front elevation of a row of three houses. The group b parking and or common outdoor space, or the apartment units outdoor community has parking, sidewalks, dumpsters, mailboxes, address identification and a community clubhouse and other amenities, much like would be expected of a community of pure apartments. The apartment parking and or common outdoor space functions much like any pure apartment outdoor community functions.

Group a's group segregated abutting outdoor leisure space makes up the rest of the grounds of the community and in this embodiment includes all of the yards that are attached to the buildings as well as their streets, sidewalks, mailboxes and everything else that is expected of a community of private homes. Group a's outdoor area looks and functions like an outdoor area of a community of private homes. In this embodiment, the homeowner units' group segregated abutting outdoor leisure space has secured gates (64) to the clubhouse area. When this gate is open it is the only time there is a break in the barrier (10P). Without these gates the occupants of the homeowners units would need to exit their community and use the apartment community entrance to gain access to the clubhouse and amenities. The developers of the community will decide if both groups should be able to use the clubhouse and amenities or just one group and how each group of units will access it.

In this embodiment the apartment parking and or common outdoor space or the apartment outdoor community and the homeowner outdoor communities, are isolated from each other by the dwellings themselves and a barrier (10P) such as a non see through fence, wall or landscaping. In this embodiment, from the moment each group enters their community they have no means to enter the outdoor community of the other group, except for the secured gates (64) that only group a units can operate in order to access the clubhouse and amenities. The renters of the apartment units can only access their units from their parking and or common outdoor space. The homeowners can only access their units from their group segregated abutting outdoor space.

These outdoor areas include the ground as well as the space above the ground up to a certain height. This space above the ground works best when complete visual privacy to the approximate height of the top of a persons head who is standing on the ground is achieved. Due to fluctuations in grade complete visual privacy may not always be practical. The elevation of the barrier, or the area inside or outside of the barrier can be altered so that from where a view could take place the viewer is less likely to see or access what the barrier is designed to conceal. Increasing the height of the barrier makes it more effective and lowering the height from which the view originates makes the barrier more effective. Lowering the height of the area that the barrier conceals relative to the barrier can also make the barrier more effective. The grading and drainage plan of the community could take these considerations into account and maximize the effectiveness of the visual blocking aspect of the barrier.

The group b units, or the apartments in this embodiment, occupy both the second story and the below grade or basement floor. The second stories of each series of three buildings are connected by a corridor (34). The lower below grade levels are also connected by an underground corridor. The second story corridor causes all apartment units to egress over and above the yards attached to their dwellings and to exit at the apartment or group b parking and or common outdoor space (88B) without seeing, encountering or being seen by the homeowners. The below grade corridor causes all below grade apartment units to egress under the yards attached to their dwellings and again causes all apartment unit occupants to exit at the apartment parking and or common outdoor space (88B) without seeing, encountering or being seen by the homeowner occupants. This corridor could be replaced with other egress means as will be shown in other embodiments.

The homeowner units provide access to the yards attached to the dwellings and to the homeowner outdoor community by any means, such as front and back doors, sliding doors or the overhead door or walk through door of an attached garage.

Each group of units has their own entrances (32A, 32B) to their outdoor communities. Each groups' entrances have a community entrance sign (33A, 33B) with different community names or logos or other attachments to identify the communities. In this embodiment the apartment entrances are angled and have barriers (10E) that when combined with a non straight entrance road (100B) prevents the apartment parking and or common outdoor space and cars from being seen from outside of the community.

From outside of the community, the community looks like a relatively low density community of private homes, yet it is a relatively high density community of multifamily dwellings. There is no reason for the apartment renters to drive into the homeowners community. It is as if the homeowners outdoor community is a neighboring community of a pure apartment community. Yet the two autonomous outdoor communities share the same dwellings, the same attached land, foundation, underground utilities and roof. One group of dwellings serves two autonomous outdoor communities.

From outside of the community the occupants must enter an entrance that has a sign identifying their community and specifically that serves their units. Once inside their respective outdoor communities neither group can access the outdoor community of the other group—with the exception of the group a units' security gate access to the clubhouse. And from inside the units each group of units has no means to access the outdoor community of the other group. In this embodiment a seamless barrier is provided from the entrance to each outdoor community through the entrance/exit point of the dwellings.

FIG. 1B is the same as FIG. 1A with the barrier (10P) that encloses the apartment parking and or common outdoor space removed. In this embodiment the privacy improvement is in the immediate outdoor space of the group a units or the group a group segregated abutting outdoor leisure space. The group segregation is provided by the means of egress which causes the group b occupants to exit at their parking and or common outdoor space. This is a considerable improvement in group privacy.

FIG. 1C—Section View

FIG. 1C is a section of FIG. 1A with the roof removed to expose the second story apartment units and egress. FIG. 1B will also familiarize the reader with the way sections of some upcoming embodiments are represented. Each second floor of each building in this embodiment has three apartment units (110B). Each apartment has an exit access door (44E) that exits to corridor (34). The corridor leads all apartment unit occupants to a set of interior stairs (69B) which lead to the exit door (52B not shown). The exit door exits or discharges into the apartment parking and or common outdoor space (88B). There is an emergency use only exit for both the second story and below grade apartment units (54B) that exits to the homeowners group segregated abutting outdoor leisure space. This exit could be equipped with an alarm if it is opened and could have a warning sign to communicate that it is only to be opened in case of emergency. A means to report that the door is open to an appropriate authority could also be installed as could any kind of camera or other monitoring device.

The apartment egress system is designed to cause the occupants of the apartment units to exit into their parking and or common outdoor space without seeing or encountering the occupants of the homeowners units.

Noise and Smell Venting

The following are some possible means to reduce noise transferred from group b units and occupants to group a units and occupants. In this embodiment, group a occupants are likely to be most concerned about noise and vibration. Doors present one of the most significant noise and vibration concerns. Installing exterior doors that close slowly will do a lot to resolve this concern. The same will work for interior doors and cabinet drawers and doors. Where group b units are built over group a units, any means to reduce floor noises could be important. Sub floor designed to reduce noise, floor padding and the flooring itself could be chosen and installed to reduce noise created by walking on the floor as well as sounds transferred through the floor. Sound insulation could be installed between the floor joists. Water that would normally be transported from group b units past group a units could be routed to minimize the sound of the water. The water pipes could be insulated to reduce the sound.

Smells vented from kitchens, baths or other sources are typically vented in the shortest or least expensive manner. Venting from group b units could improve group privacy by either venting through the roof or to their parking and or common outdoor space (88B) or in other embodiments to their group segregated abutting outdoor leisure space.

FIG. 2A—Windows

FIG. 2A shows one embodiment of windows, bedroom emergency escape and rescue windows, and an exterior door for group a units (52A) of a dwelling as well as group segregated abutting outdoor leisure space for group a (88A) and group b parking and or common outdoor space (88B not shown). A barrier (10P) provides visual and physical separation for the two groups. The first floor windows and door belong to group a units. Most of the discussion of FIG. 2A will focus on the windows, but any opening or see through material could apply. The two main functions of fixed windows are to allow views out and light from outside to flow in. Two additional functions of operable windows are to allow air from inside and outside to circulate. When operable windows are open they also allow sounds to flow in or out. This relatively simple element of a window or other see through material or opening creates a number of group privacy concerns. Reasonable people can disagree as to which of the means contained in this patent application achieves the overall best solution for achieving the best mix of the four window functions.

Below grade emergency escape and rescue windows could be replaced by a bulkhead enclosure which could be for emergency use only and be equipped with warning signs and a means to monitor if it is opened.

In this embodiment group a units occupy the first floor space. Most dwellings in this embodiment and most dwellings in general are built such that the height of the first floor is higher than the ground outside of the dwelling. When group a occupants enter their dwelling they are at a higher height than when they are outside. It is preferable to have windows at these locations. The barrier may be designed to prevent views to occupants who are outside at ground level. It may not be desirable to build the barrier high enough to prevent views over the barrier and down into the group b parking and or common outdoor space from the elevated height of a first floor window. For this reason, group a window views could be blocked, distorted or eliminated where their sight line is higher than the height of the exterior barrier (10P) and lower than the typical eye height of a person inside the unit.

First Floor Group a Unit Windows

The first floor of this dwelling, and most dwellings in general, are higher than the ground outside. The line of sight to see straight over the barrier (10P) is indicated by (74A). The estimated occupant standing eye height for the first floor units or group a units is indicated by (83F). If someone were looking out the window or door with glass (52A) below the line of sight (74A) and they were looking at the barrier they would be seeing beyond the barrier in the upward direction. In this embodiment the line of sight to see exactly straight over the barrier (10P) and not down is (74A). Conversely if they were looking out the window from a vantage point that is above the line of sight (74A) they could look over the barrier in a downward direction. This could allow people standing in a group a unit to see people, cars, other outdoor assets of group b units or even the ground of the group b units' parking and or common outdoor space. Therefore in this embodiment, the window section between the line of sight (74A) and the estimated occupant standing eye height (83F) would allow a view over the barrier in a downward direction. This is not desirable.

In this embodiment we use distorted view glass block at that point (129A) to allow light in without allowing clear views out. A more popular embodiment may be glass with a coating or glaze that distorts the view out but allows light in. Many other view blocking means are possible. That section of the window (129A) that could allow views out in a downward direction over the barrier could use any appropriate distorted view material or use any view blocking means such as fixed louvers or other fixed view blocking means which will be discussed in the alternative embodiments. That section of the window could be eliminated. Here we show glass block because it is easy to identify on the drawings as well as being well known and effective for exterior glass. Another alternative is to allow group a occupants to choose to use an occupant controlled view blocking means such as drapes, louvers or the like. In this situation group b occupants would have to be the type of occupants that would not care if group a occupants could see over the barrier of their parking and or common outdoor space. This is the case for most apartment renters.

In this first embodiment ⅓ of the dwellings are attached to a group b parking and or common outdoor space. Therefore one wall of ⅓ of the group a units have a wall that serves as part of the barrier. In this embodiment those group a unit walls do not have windows. However windows could be installed with any of the above view blocking means. Other view blocking means for this situation where a group a unit wall abuts a group b parking and or common outdoor space or a group b group segregated abutting outdoor leisure space will be discussed in additional embodiments.

Group a units first floor bedroom emergency escape and rescue windows follow the same principles as standard group a first floor windows and voids. These windows need to follow building and fire codes which may limit some fixed view blocking means. Void, as the term is used herein, refers to windows, bedroom emergency and escape windows or other bedroom emergency escape and rescue means, doors, sliding doors, or any see-through material that allows views to the outside, or an operable opening that could allow views to the outside.

Instead of treating or eliminating the group a unit windows, the barrier could be built higher to eliminate any downward view. The grading and drainage could be designed to maximize the height of the barrier and or minimize the height of the dwelling and consequently lower the height of the group a units first floor and windows. The grading and drainage could lower the height of the group b outdoor area that it contains. The grading and drainage could be designed to make areas of the entire community more flat so that the barrier is more effective over more distant views.

Second Floor Group b Unit Windows

In this embodiment the second story windows or any second story void are part of the group b units. Second story windows would typically have a view of most of the land that the windows overlook. The preferred group privacy embodiment of any group b unit window or void is to enable them to see out as much as possible without seeing the group segregated abutting outdoor leisure space of the group a units and without seeing the windows, doors or other voids of group a units. The preferred embodiment also allows as much light to flow into the group b units through the windows as is possible and economical.

The second story windows belong to group b units and could have a view directly down to the group a group segregated abutting outdoor leisure space (88A). These windows need a view blocking means from the top sight line relative to a persons standing eye height on the second floor (83S) down to as low as the window extends. If it is determined that the maximum height of a persons eyes to be at 72" then this height is 72." In this embodiment I again use distorted view glass block to allow light in without allowing views out. Also, these windows are non operable in this embodiment. If the windows are opened the non see through window no longer blocks the view. However in other embodiments these windows could open and a material or other substance could fill the open space to eliminate or distort the view. Many other view blocking means are available.

That section of the window (129B) could use any appropriate distorted view material or use any view blocking means such as fixed louvers or other fixed view blocking means which will be discussed in the alternative embodiments. That section of the window (129B) could be eliminated. In this embodiment it is not likely that the group b units could opt for the occupant controlled view blocking means as many occupants of the group a units would not like to be seen by the occupants of the group b units when members of group a units are outside or near their voids.

The windows or portion of the windows above the line of sight (83S) do not need a view blocking means. The windows above the line of sight could be operable unless it is determined that having an open window creates an audible group privacy concern. So another embodiment could only install clear view windows that are above the line of sight and no other windows except if or where required by code.

Reasonable people will disagree as to if distorted view glass or a fixed view blocking means are preferred. However, if the windows that are below the line of sight are operable the distorted glass embodiment may not provide visual blocking when opened indicating that a fixed view blocking means be used, or a means to have the window open in a way or direction that does not allow for a view into the group a secluded outdoor area. Alternatively, when the windows open the opening could be automatically filled with a material that allows light and air to pass without allowing a clear view out.

Bedroom Emergency Escape and Rescue Windows

Group b units second story bedroom emergency escape and rescue windows will follow similar principles. These windows typically must be operable at a level that would allow a line of sight down to the group a units group segregated abutting outdoor leisure space when a distorted view window is open. Placing them so that they only overlook their own outdoor area is an option, but often is not possible. These windows could be placed where they would cause less of a group privacy issue such as overlooking a group a group segregated abutting outdoor leisure space but at a location that is not as intrusive such as at the sides of the dwellings relative to group a units' perspective. A balcony or other code acceptable open window view blocking means could be used to block the view down to the group a group segregated abutting outdoor leisure space when the window is open. It could be equipped with a means to monitor if it is opened. This means could sound an alarm or send a report to an authority who monitors the window, or both. The window could have a warning posted on or near the window warning not to open except in emergency. In this way, the occupants would be discouraged from opening the window except in emergency.

The bedroom emergency escape and rescue window could have a balcony, false balcony or other code approved means to block the view when the window is open. An alternative means to provide bedroom EE&R could be provided such as a corridor or egress to a three or four sided courtyard.

FIG. 28 shows one possible embodiment of a bedroom emergency escape and rescue window. Building codes often require a minimum sill (92) height which can be around 42"-44" off of the floor. If it were determined that the estimated occupant standing eye height were 72" (83S), this embodiment could be as follows, among many other options. In this embodiment the sill is approximately 42" off of the floor. The lower half of the window has distorted view glass (129B) and is 30" tall. So the 42" of wall below the window plus the 30" lower distorted view glass=72" in which the occupant would only have a view out the window in a straight or upward direction.

Conversely to above grade windows, below grade windows that are installed at the highest point on the below grade wall present the biggest visual group privacy concern. Typically below grade windows are installed at the highest point possible. Some similar means to the above grade windows can be used to block below grade views. Non clear view material or louvers could be used. Landscaping could also be used providing greenery in addition to view blocking. Below grade windows that are installed below grade typically have window wells installed around them as indicated by (144) returning to FIG. 2A. The window well could be taller than is typical allowing the well to be installed so that it protrudes higher out of the ground limiting the view from below to a nearly straight up view. This window well can have a cover that is easily removed from inside the unit in case of emergency as would likely be required by code. This cover could be made of a non clear view material to provide the view blocking means.

Where sound or smell is a group privacy concern, the windows could be placed where this is less of a concern such as the side yards relative to group a units perspective or they could be non operable-except for bedroom emergency escape and rescue windows or where required to be operable by code. An alternate means to provide fresh air could be used if desired or required.

Below grade bedroom emergency escape and rescue windows typically must have an operable window at 42" or less off of the floor. The lower part of the window does not create much of a visual group privacy issue as the line of sight out from the lower height provides a nearly straight up view. The lower section could be made of a clear view material without compromising group privacy. As a below grade group b unit window becomes higher in the wall the view out goes from nearly straight up to closer to a forty five degree angle at the very top increasing the visual field to air space above group a units outdoor assets or group a occupants who are standing outside near the window. Similar means as for standard below grade windows are used to block the objectionable group privacy view.

The window well could extend out of the ground further than is typical or the higher part of the window or all of the window could be distorted view. Where sound or smell is a group privacy concern, the windows could be placed where this is less of a concern such as the side yards relative to group a units perspective. It could be equipped with a means to monitor if it is opened. This means could sound an alarm or send a report to an authority who monitors the window, or both. The window could have a warning posted on or near the window warning not to open except in emergency. In this way, the occupants would be discouraged from opening the window except in emergency.

A below grade EE&R window could have a barrier around it with a code acceptable opening. Any barrier could be used. The barrier could be attached to the dwelling or the ground, or grow out of the ground such as bushes, trees or other plantings. The window, or part of the window, could be made of a distorted view material or other means to block the view.

Any window, except bedroom emergency escape windows, could be non operable unless not allowed by code. An alternative means to provide fresh air could be provided. This could be a mechanical means such as with the HVAC system or other mechanical ventilation or a passive system that only has openings at that groups parking and or common outdoor space or that groups group segregated abutting outdoor leisure space or through the roof or other non objectionable group privacy location.

Any distorted view window could open in such a way as to not compromise the view when opened. The window could hinge from the bottom or a particular side without compromising the view. It could open from any direction and have a non see through material fill the opening while still allowing air and possibly light to flow through.

It could be determined that any window regardless of location does not present a significant enough group privacy issue to have any special treatment or consideration.

FIG. 2B—Grading

FIG. 2B shows the same dwelling, windows and doors as FIG. 2A with a grading and drainage plan that does not maximize the height of the barrier (10P). The low point of the grading and drainage plan is (66L). This causes the barrier to drop by the same distance as the fall in the grade (57). The line of sight (74A) from inside the first floor group a units now will allow a person to look over the barrier in a downward direction. If the barrier is built along this grade, the line of sight (57) is lower by the same amount the barrier falls with the grade (57). To prevent a view over the barrier in a downward direction the distorted view window material (129A) would need to extend down by the same distance as the fall in the grade at the barrier (57). The grading and drainage plan could make the barrier more effective if it were designed to cause the important parts of the barrier to be the high point of the grading and drainage plan. The grading and drainage also makes it more likely that a group a unit occupant standing at a high point in their yard such as near the house, could see over the barrier as it falls to the low point of the grade (66L). Another alternative is to build the barrier taller where needed to prevent views as desired.

FIGS. 3A, 3B, 3C—Landings with View Blocking Means.

The barrier around each groups outdoor area may be designed to only block views from a normal persons standing view at ground level, or grade. When either group is at a higher elevation than grade, the barrier may not provide visual blocking from the elevated height to the other groups outdoor area. FIGS. 3A, 3B and 3C show a perspective, side and top down view of how views from the higher elevation of an exit landing pad can be reduced or eliminated by surrounding the upper portion of the landing pad and steps to grade with louvers (76). The louvers are arranged to only allow views out in the upward direction. The louvers block the view from a higher elevation over the barrier and into the other groups outdoor areas. The louvers allow light to flow in and smoke to ventilate out. This could eliminate the need for lighting and also qualify the landing and steps as exterior components which may be beneficial for complying with building and fire codes in a cost effective way. This louver embodiment has no roof as a roof is not required to achieve group privacy, however it could have a roof or be completely enclosed.

The above first embodiment shows how two groups of people can inhabit the same buildings and community yet never see or encounter each other. Each group enjoys an environment similar to what they would expect if they lived in separate communities. The hybrid buildings and community are much less expensive to build and maintain compared to two separate buildings and communities. Adding a floor of apartments or commercial space to what would otherwise be a community of private homes is less expensive than building separate home and apartment communities or commercial buildings The apartment community piggy backs on the land, foundation, roof and outdoor maintenance of the community of private homes. The hybrid footprint is much smaller compared to the alternative of two separate communities. Integrating and possibly concealing the group b parking and outdoor area within the community makes the overall community feel more open and quaint than even a low density single family community. Groups who need first floor space and attached yards can be combined with those who don't, maximizing the assets of the buildings and community. Going forward, all low rise apartment buildings and office buildings could be built into a community of private homes, eliminating most of the footprint of the apartment and office communities.

Additional and alternative embodiments are shown in FIGS. 4 to 27. Unless otherwise noted, in the following embodiments group a units are located on the first floor and group b units are on the second floor. As with the first embodiment this is not a requirement.

Figure 4:
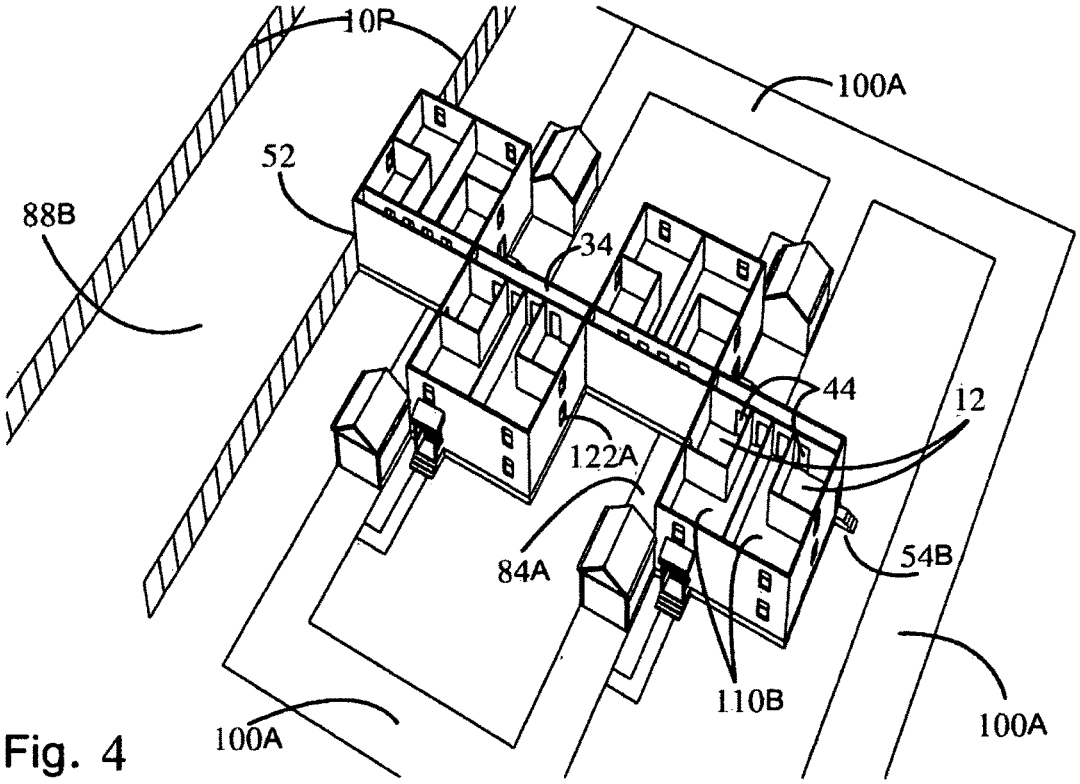
FIG. 4 shows a community section similar to 1C with a side group b parking and or common outdoor space except that group a does not have back yards and the buildings are connected allowing fully housed egress without a connecting corridor.

FIG. 4 is similar to the first embodiment. A group b parking and or common outdoor space (88B) is at the side of the dwellings relative to group a units' perspective. The group b parking and or common outdoor space is again enclosed by a barrier (10P) that includes the dwellings themselves and a non see through fence or wall. The remainder of the outdoors is group a units' group segregated abutting outdoor leisure space. Again these two areas are completely separated by the barrier, but this barrier is not required for significantly improved group privacy. This will be the same for next series of drawings. Eight group b units (110*b*) are all located on the second floor.

A series of four dwellings overlap at the back allowing for a corridor (34) to provide egress for all group b units without having a connecting corridor between buildings as was the case in the first embodiment. The corridor has one standard exit (52 not shown) that exits at the parking and or common outdoor space (88B) and one emergency only use exit (54B) that exits to the group a group segregated abutting outdoor leisure space. This emergency use exit could be monitored and have an alarm sound if opened and have a sign indicating emergency use only. The corridor is in effect the barrier that creates the group segregation for the group a units which in this embodiment is the only group that has group segregated abutting outdoor leisure space. If group b units were the only units that had access to a clubhouse and outdoor amenities then group b units would have segregated outdoor leisure space but it would not be abutting the buildings so it is not the same type of outdoor space.

Group b unit bedrooms (12) are located at the corridor and have a door to access the corridor (44). This could provide an alternative bedroom emergency escape and rescue means other than the typical window in an exterior wall. There are no back yards in this embodiment. Group a units have side patios or decks or yards (84A). Group a utilizes any of the previously discussed window view blocking means for neighbor to neighbor privacy at their side yards where a neighbor overlooks the patio of another group a unit (122A).

Group a or b units could occupy any floors. Group b units simply don't have a normal means of egress to group a units group segregated abutting outdoor leisure space (all outdoor space except 88B). Windows, grading and drainage, elevated outdoor space, interior noise and interior smell venting is treated as discussed in the first embodiment. This will be the case with the following embodiments unless otherwise noted. Until further noted, each embodiment can provide complete visual and physical separation of the two groups anywhere inside, outside or throughout the community, but complete group privacy is not a requirement. Only an improvement in group privacy is required.

Figure 5:
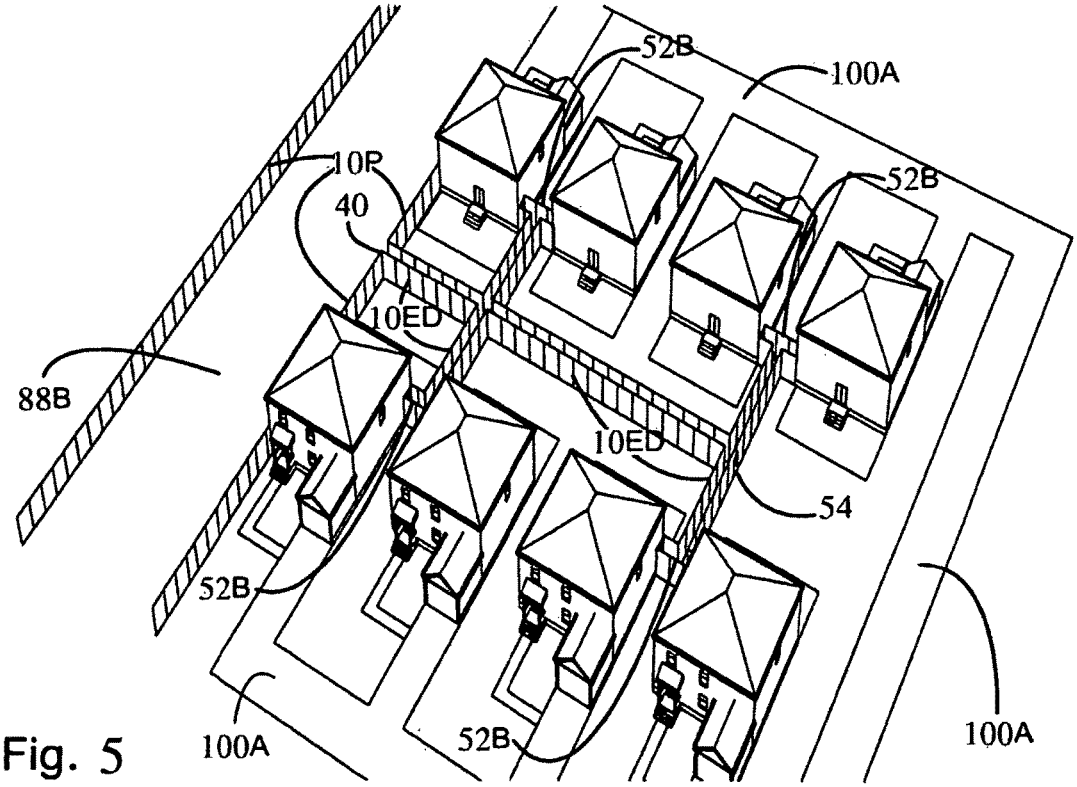
FIG. 5 is another section of a community similar to FIG. 1A in which group b units have egress discharge with a barrier on each side.

In FIG. 5 a corridor is not used to join the buildings and the group b units don't allow them to directly exit to the group b parking and or common outdoor space (88B). Instead there is an exit door at each building (52B) and the group b units' egress discharge (40) is surrounded by a barrier (TOED) from the group b exit at grade (52B partially not shown) until it connects with the barrier (10P) of the group b units' parking and or common outdoor space (88B). This allows the group b units to exit and discharge into what is otherwise a group a group segregated abutting outdoor leisure space (all areas outside of the group b secluded outdoor area—88B—is group a units' group segregated abutting outdoor leisure space) without the two groups seeing or encountering each other. This group b units' egress discharge continues a seamless physical barrier from the group b parking and or common outdoor space all the way to the group b exit doors (52B partially not shown). Another embodiment could have exterior stairs in which case the seamless physical and visual barrier would be continued as will be shown in other embodiments.

There is an emergency use only exit from the enclosed discharge located at the far right side of the enclosed discharge (54). The emergency exit could be located at a different location or multiple locations and may not be required at all. As with any group b units' emergency exits, it can be equipped with a monitoring means, an alarm and signage indicating it is for emergency use only. The building that abuts the group b secluded outdoor area could allow the group b units of that dwelling to egress directly to the group b parking and or common outdoor space.

Figure 6A:
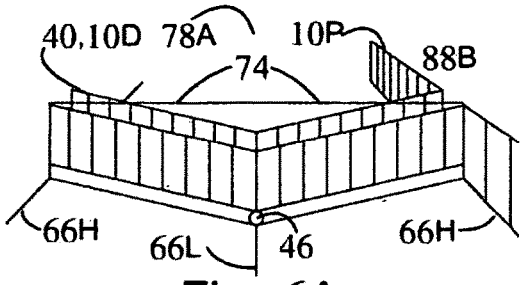
FIG. 6A shows how uneven grade can cause a group privacy concern with egress discharge that is enclosed on two sides and not on the top or with a roof.

FIG. 6A shows a group b walkway or discharge (40) that is enclosed by a barrier (10D). The walkway is built over an uneven grade. In this embodiment the low point of the grade (66L) is located at the center of the drawing. This low point could be located anywhere and may be preferable closer to the barrier (10P) that divides off the group b parking and or common outdoor space (88B). A drain pipe (46) is used to help water drain under the walkway at the low point. The line of sight (74) from a high point of the grade (66H) allows for a view over the barrier ahead as the barrier drops with the grade. Under these conditions group b occupants could see over the barrier into group a units' group segregated abutting outdoor leisure space (78A).

Figure 6C:
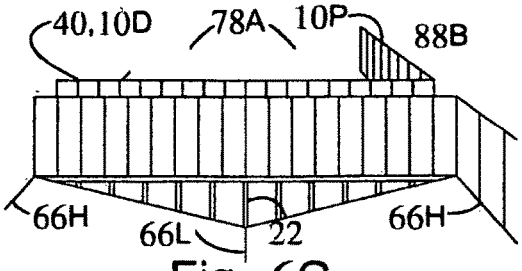
FIGS. 6B-6D show solutions to the problem of uneven grade and egress discharge without a roof.
Figure 6B:
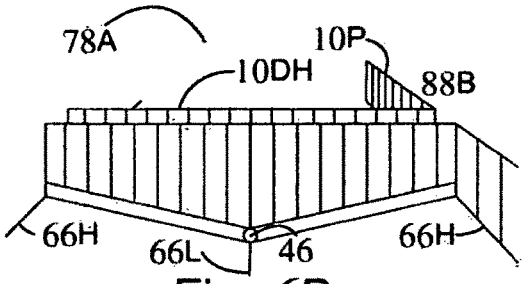
Figure 6D:
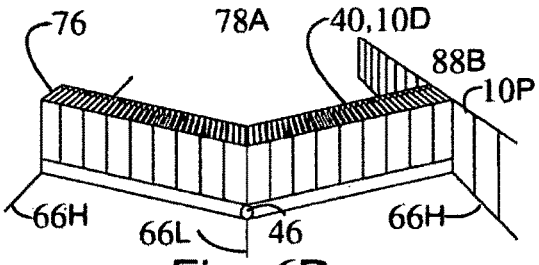

FIG. 6B shows one possible solution of building the barrier higher (10DH) as the grade and walks built on grade fall with the elevation. As the grade drops the top of the barrier does not drop, instead the barrier becomes taller. FIG. 6C shows another solution where the walks are kept level when passing over an uneven grade belonging to the group a units group segregated abutting outdoor leisure space (78A). A bridge or built up span (22) is used to keep the walks or discharge (40) level The barrier (10D) on each side of the discharge walks (40) are all the same length in height. FIG. 6D shows another way to treat uneven walks over uneven grade that have a barrier around them. Horizontal louvers (76) are used to prevent or reduce views outside of the barrier (10D) that encloses the discharge walks (40) and into the group segregated abutting outdoor leisure space of group a units (88A). The louvers allow light in and smoke out while limiting most views outside of the barrier to an upward direction. Another possibility is to simply build the entire barrier higher regardless of the grade.

Generally fences six feet and under are not required to be part of the building permit. These discharge walks with barriers could be long. Generally an emergency exit is not required along the length of the barrier regardless of its length but could be added if required or desired. The emergency exit could have an emergency use only warning sign and a means to monitor if it is opened. Which solution works best here will likely vary depending on many factors including cost, grade and zoning or building codes.

Figure 7:
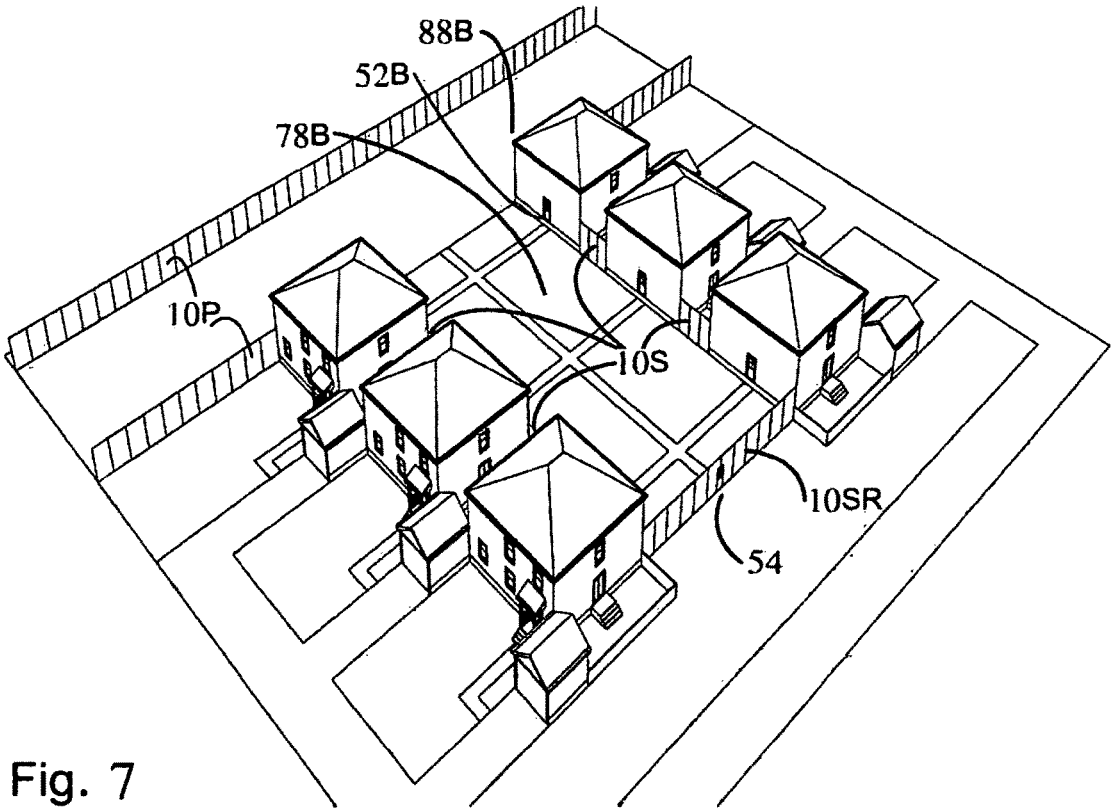
FIG. 7 shows that the group b units now includes a group segregated abutting outdoor leisure space located at the back yards relative to the perspective of the group a units.

FIG. 7 provides the group b units with a group segregated abutting outdoor leisure space (78B) at what appears to be the back yards from the perspective of the group a units'. So now the backs of the dwellings have a barrier between each building (10S). There is also a barrier at the far right side of the dwellings (10SR) which has an emergency use only discharge exit (54) if required or desired. As with all group b units' emergency exits it could be monitored, an alarm could sound if opened and a warning sign could be posted. These two barriers (10S, 10SR) together with the buildings create the two group segregated abutting outdoor leisure spaces. Group b could have some first floor space in each building and have access to abutting outdoor space. In this embodiment the group b exit doors (52B) are located at the back of the dwellings relative to group a units' perspective. The group b group segregated abutting outdoor leisure space that is behind the buildings (78B) could provide the parking for the group b units and the side parking and or common outdoor space (88B) could be a road enclosed by a barrier or not enclosed by a barrier. Any group b parking and or common outdoor space of any embodiment could be an area for roads only.

FIG. 8A shows how louvers (76) provide a view blocking means for exterior stairs for any embodiment. A common reason exterior stairs are used instead of interior stairs is to meet building and fire codes in a way that does not require fire suppression or does not require more fire suppression or more costly fire suppression. So any building, fire or zoning code acceptable view blocking means would be acceptable. The exterior stairs could be replaced with interior stairs wherever desired or required. The stairs could have a code acceptable roof.

If the group b units of FIG. 7 were on the second floor, it might be preferable to use exterior stairs to egress to grade rather than interior stairs. This could be the case for almost any embodiment. The arrangement of louvers (76) in the upward direction that surround the stairs allow light, air and smoke to flow without allowing views out and down to the other groups secluded outdoor area. This arrangement may be useful with building and fire codes as it likely qualifies as outdoor stairs and allows smoke to freely ventilate out. This could reduce or eliminate the requirement for fire suppression. The stairs do not require this quantity of louvers. Alternatively the stairs could have walls and or a roof that are vented in any way to satisfy building and fire codes while still limiting views as desired.

FIG. 8A is a perspective view, 8B is a side view and 8C is a top down view. The louvers, walls, roofs or other view blocking means only need to be placed, arranged and located to avoid views to the group segregated abutting outdoor space of the other group. Here they are shown all the way down to grade which is not required but may be preferred for aesthetics. There could be a detached view blocking means such as a fence, wall, garage or other structure or landscaping. The exterior stairs could be built with one side attached to the dwelling or inset into the structure to reduce views where building and fire codes allow. The placement of the stairs could also limit the views to the other groups secluded outdoor area.

FIG. 9 is similar to FIG. 7 except that the second story group b units have a balcony (8). In this embodiment the balcony also serves as part of the means of egress by leading all units to a set of exterior stairs (56B) at the far end. This arrangement could work with many other embodiments. For example, the corridor of the first embodiment could be removed and replaced with an egress balcony. Louvers or other view blocking means could be added to limit views to group a's secluded outdoor areas if needed. The group b exits could be anywhere along this balcony. Each unit could have a set of exterior stairs or the stairs could be combined with any number of other units. The exterior stairs could have a view blocking means such as louvers if it overlooked a group a group segregated abutting outdoor leisure space (78A) on the other side of the group b parking and or common outdoor space (88B). The barrier between the buildings is a two story wall (10STSW) that is not necessarily part of the structure of the dwellings. However it could be made to look like part of the buildings. The barrier or wall at the right end is also shown as a two story wall (10SR) and could also be treated to make it look like part of the structure of the dwellings. The wall has an emergency exit (54) if required or desired. These two barriers (10STSW, 10SR) along with the buildings create the segregation for the two group segregated abutting outdoor leisure spaces. All outdoor space that is not (88B or 78B) is group a units' group segregated abutting outdoor leisure space.

Figure 10A:
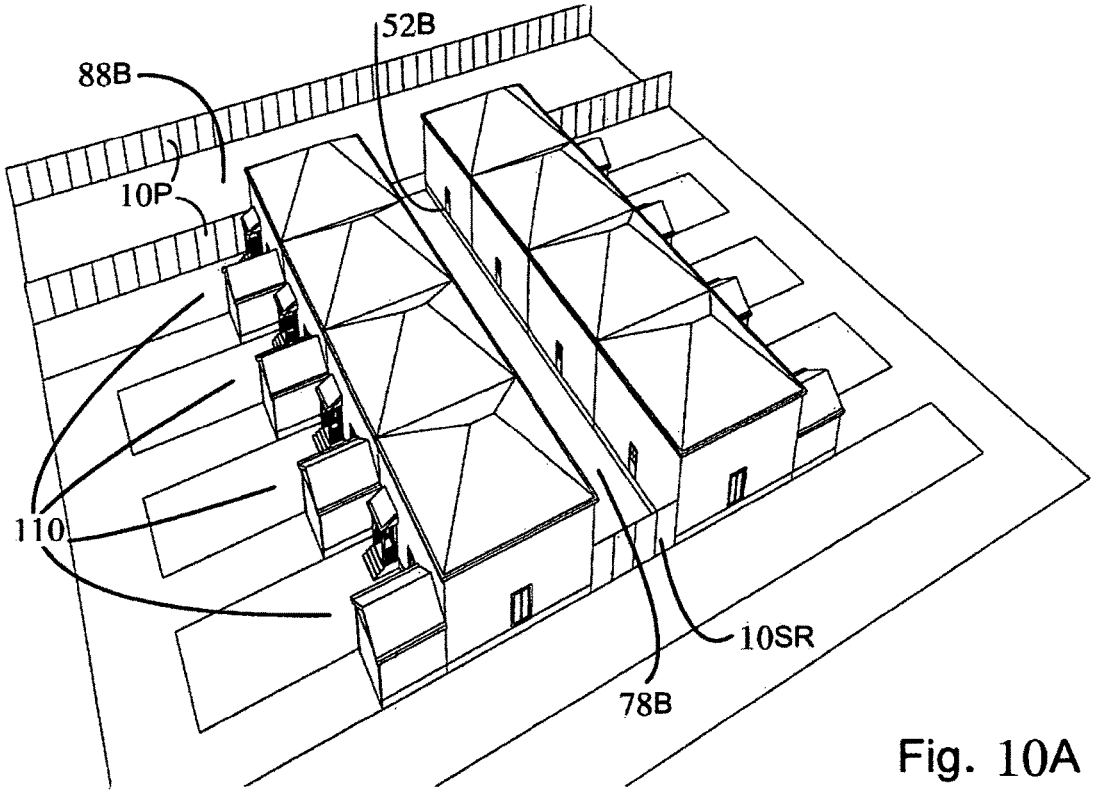
FIG. 10A shows four connected group a units which provide most of the barrier for the back yard section of the group b units group segregated abutting outdoor leisure space.

FIG. 10A shows four group a units in a row attached (110). The group b exit doors are at ground level (52B) which requires only an approximate six foot high barrier on the right side (10SR). The stairs could be exterior with an exit door at the second floor in which case it may be desired to install a view blocking means around the stairs so that the group a group segregated abutting outdoor leisure space is not visible from the elevated height of the stairs. Alternatively the barrier on the right side (10SR) could be taller to prevent the undesired view. As with any embodiment, an emergency use only exit (54) is provided if required or desired and can be equipped with a monitoring means, an alarm and a warning sign. Because the buildings are attached the buildings provide the remainder of the barrier at the back section of the group b units group segregated abutting outdoor leisure space (78B).

Figure 10B:
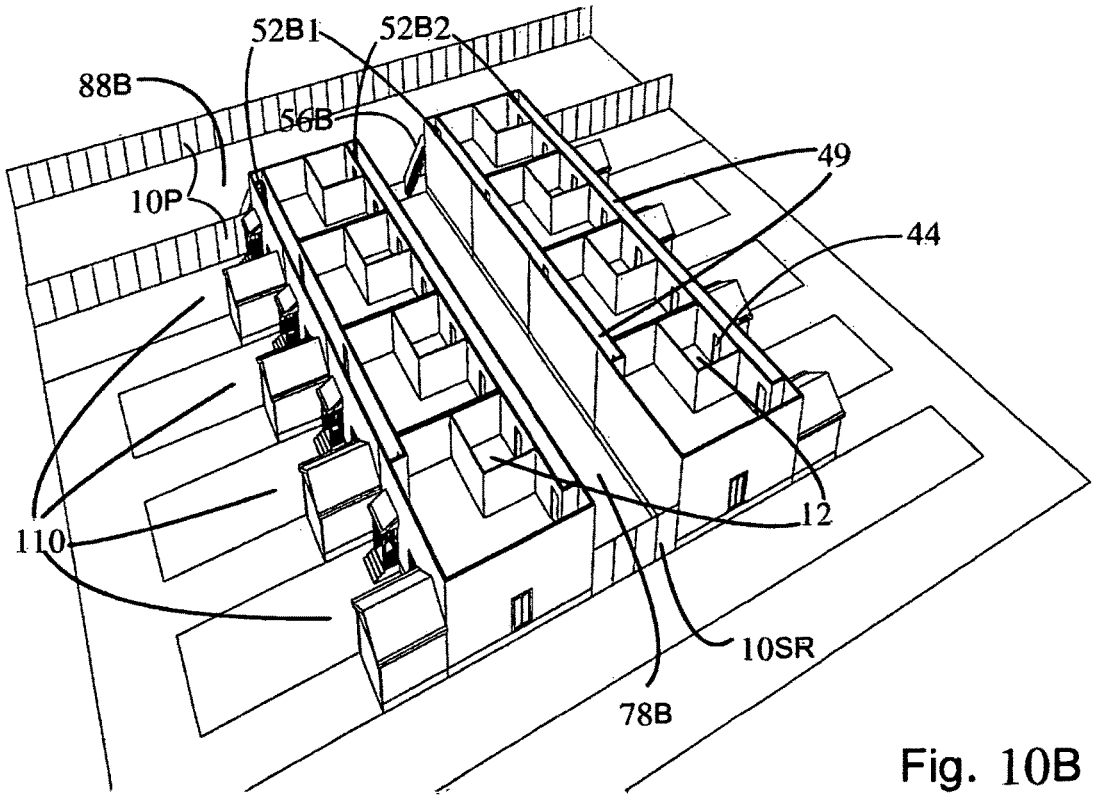
FIG. 10B is similar to FIG. 10A with the roofs removed revealing an alternative egress means and alternative bedroom emergency escape and rescue means.

FIG. 10B shows an embodiment similar to FIG. 10A but where the second story group b units have two exits (52B1 not shown), (52B2 not shown). This provides the units of each building with an alternative means of egress with two egress access or corridors (49) and two exits that exit to the group b units parking and or common outdoor space (88B). This second exit would not be required to be emergency use because it exits to the parking and or common outdoor space of the group of units it serves, group b units. The group b units' bedrooms (12) utilize the second means of egress to use as an alternative to the typical exterior egress window where code allows. The bedrooms have a door (44) directly from their bedroom to the egress access hall (49).

Figure 11A:
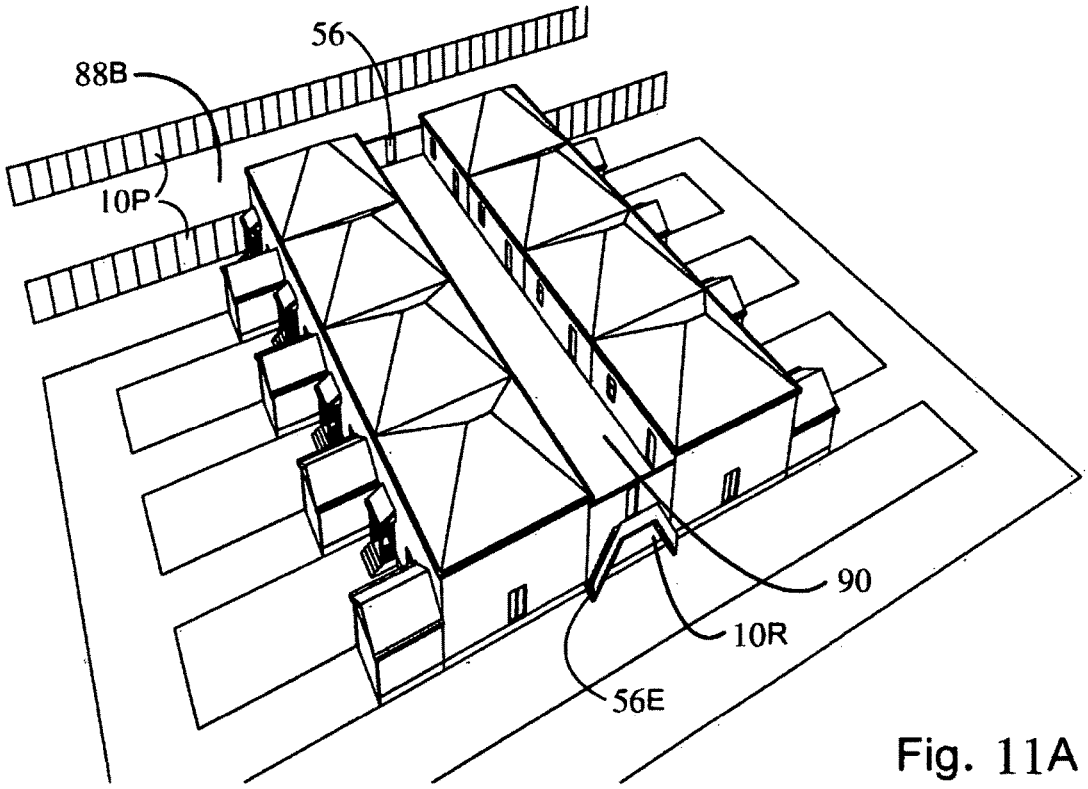
FIG. 11A shows a built up outdoor area that is attached to the dwellings for group b units.

FIG. 11A is similar to 10A except that the second story group b units have secluded outdoor space that is built (90) and is not just at grade or ground level. This section of the outdoor area can be built over living space below or could be built as a raised second story patio with no living space below. It could be built at any grade. There is an opening to a set of exterior stairs (56) that serves as part of the egress system. The wall on the right side acts as the barrier (10R) at the second story on the right side of the group b outdoor space that is built. At the first floor the wall (10R) simply conceals the structure behind it. There is an emergency use exit stairs (56E) on the right side. A door could serve the emergency stairs; however an opening may be required by code. If so, the stairs could have a view blocking means to block the view from this opening.

Figure 11B:
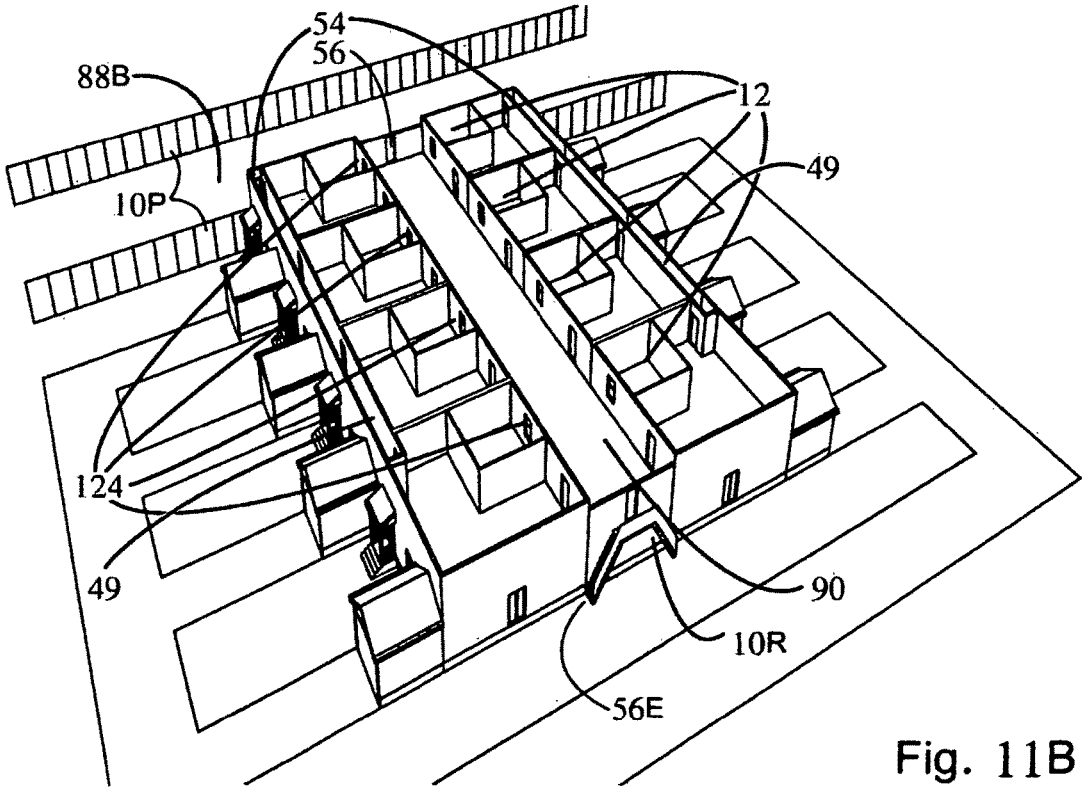
FIG. 11B shows a similar built up area as in FIG. 10A which could also serve as the bedroom emergency escape and rescue means for group b units where allowed.

FIG. 11B shows an alternative means for providing bedroom emergency escape and rescue. Group b units' bedrooms (12) and bedroom emergency escape and rescue windows (124) are located at the secluded outdoor space that is built (90) and could provide a code acceptable way for bedroom emergency egress without the need for a window overlooking a group a group segregated abutting outdoor space (all outdoor space except 88B and 90). In this embodiment a code acceptable window (124) is used for the bedroom emergency escape and rescue, however it could be a code acceptable door. Here a second means of egress is provided at the back of the units (49) where the exit (54 not shown) ends up at the group b parking and or common outdoor space (88B). In this arrangement the second exit would not need to be for emergency use only.

Figure 12A:
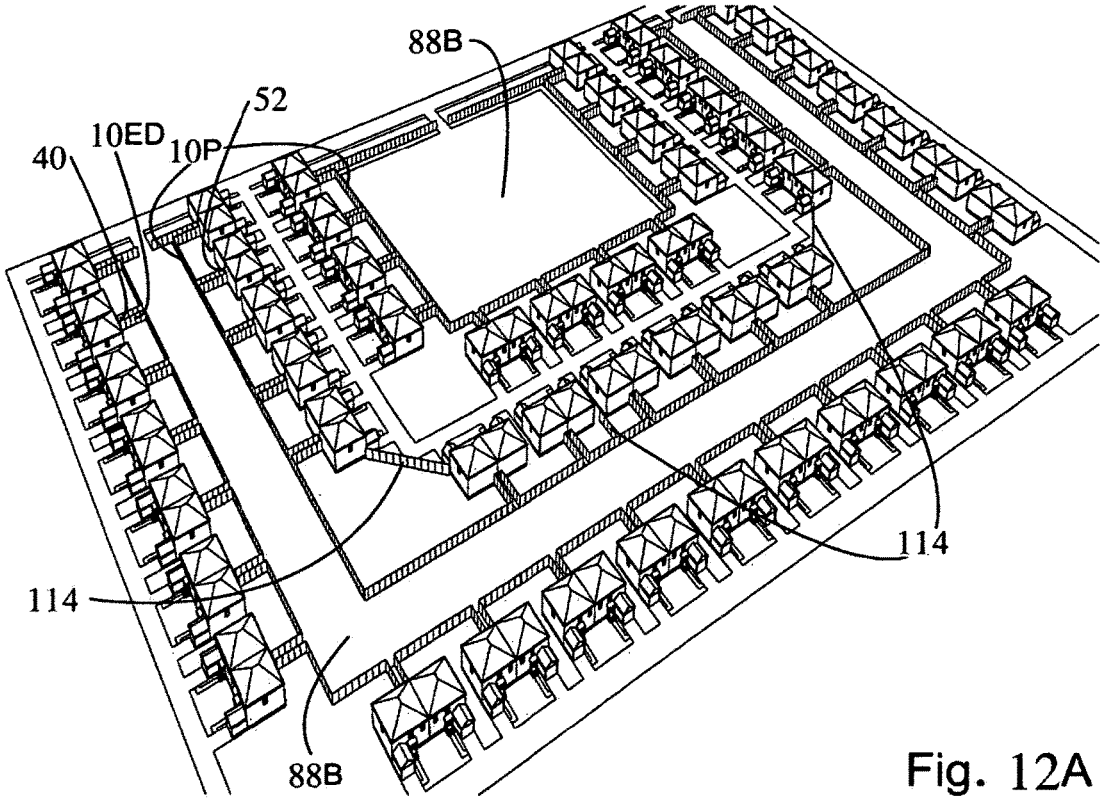
FIG. 12A shows an embodiment where the group b units parking and or common outdoor space is detached at the back relative to group a units' perspective.

Group b Units Parking and or Common Outdoor Space Located at the Back Relative to Group a Units' Perspective FIG. 12A places the parking and or common outdoor space of the group b units (88B) at the back relative to the perspective of the group a units. All other outdoor space is group a group segregated abutting outdoor leisure space. These buildings are shown as attached twins. As with any embodiment they could be virtually any type of buildings. Each group a unit in this embodiment occupies the first floor of each twin. Each building has two group a units. As with any embodiment there could be any number of group b units above, below or beside each group a unit. The group b units exit into what is otherwise group a group segregated abutting outdoor leisure space. For this reason the group b discharge (40) is enclosed by a barrier (10ED) on each side until the discharge reaches the group b parking and or common outdoor space (88B) which is enclosed by a barrier (10P).

In this embodiment there is one exit door (52) from each building for all of the group b units of that building. As with most embodiments each building could have any number of exits for the group b units and the stairs could be interior or exterior stairs. If emergency exits are required or desired at the enclosed egress discharge they could be placed anywhere and could be equipped with a monitoring means, an alarm and a warning sign not to open, among other means. The location of the buildings and the size of the group b outdoor areas are such that if the grade of the land varies much there may be views over the barrier at a distance. The master grading and drainage plan can be engineered to minimize this issue. Additionally the barriers around the group b discharge can be utilized to minimize this effect. Also with any embodiment the barriers could be built higher to improve group privacy. As with any embodiment, complete group privacy is not necessary, just improved group privacy.

In this embodiment there are two separate group a unit group segregated abutting outdoor leisure spaces and two separate group b unit parking and or common outdoor spaces. This could allow for four different groups of unit types.

Figure 12B:
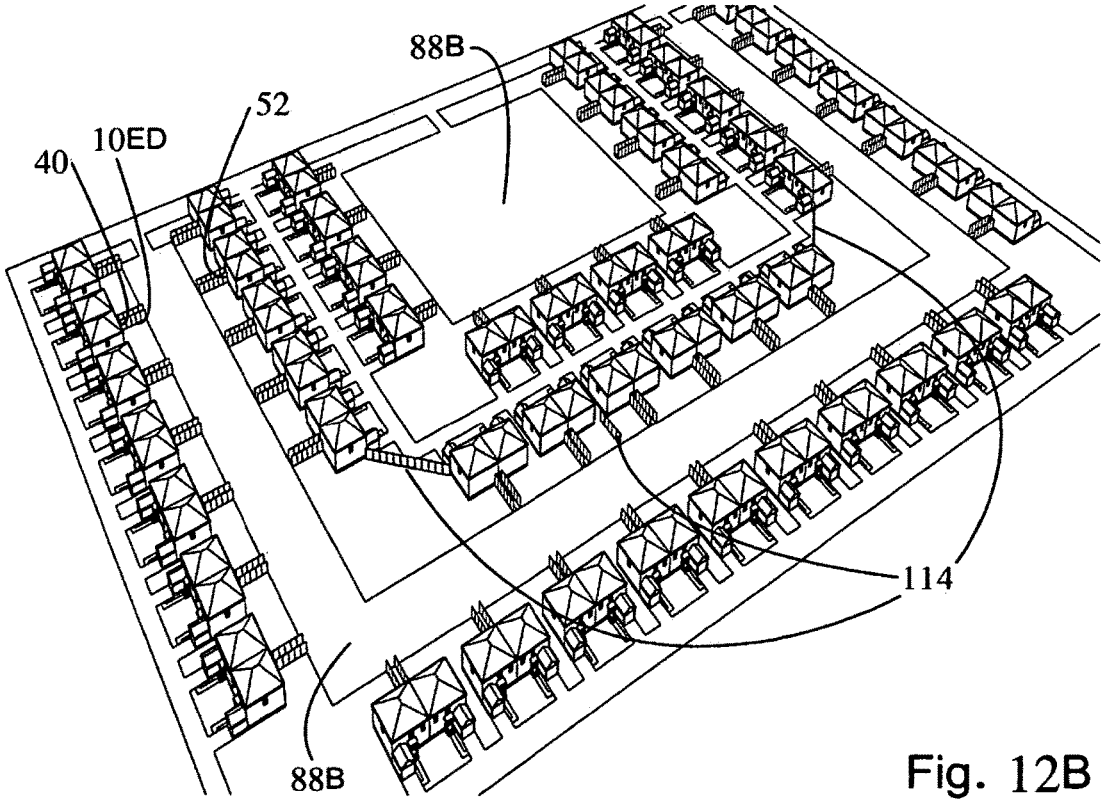
FIG. 12B is the same as FIG. 12A except that the barrier for group b parking and or common group b outdoor space has been removed to isolate intimate group privacy.

FIG. 12B is the same as FIG. 12A with the barrier for the group b units parking and or common outdoor space removed (10P not sown here—see FIG. 12A). Here the barrier (10ED) around the egress discharge walks (40) provides the most intimate part of providing the group a units with group segregated abutting outdoor leisure space (all outdoor space except 88B). The window, louvered steps and stairs and uneven group b discharge walk solutions also provide intimate group privacy allowing the group a units to operate like private homes that back up to a parking lot-even without the parking lot barrier.

Figure 13:
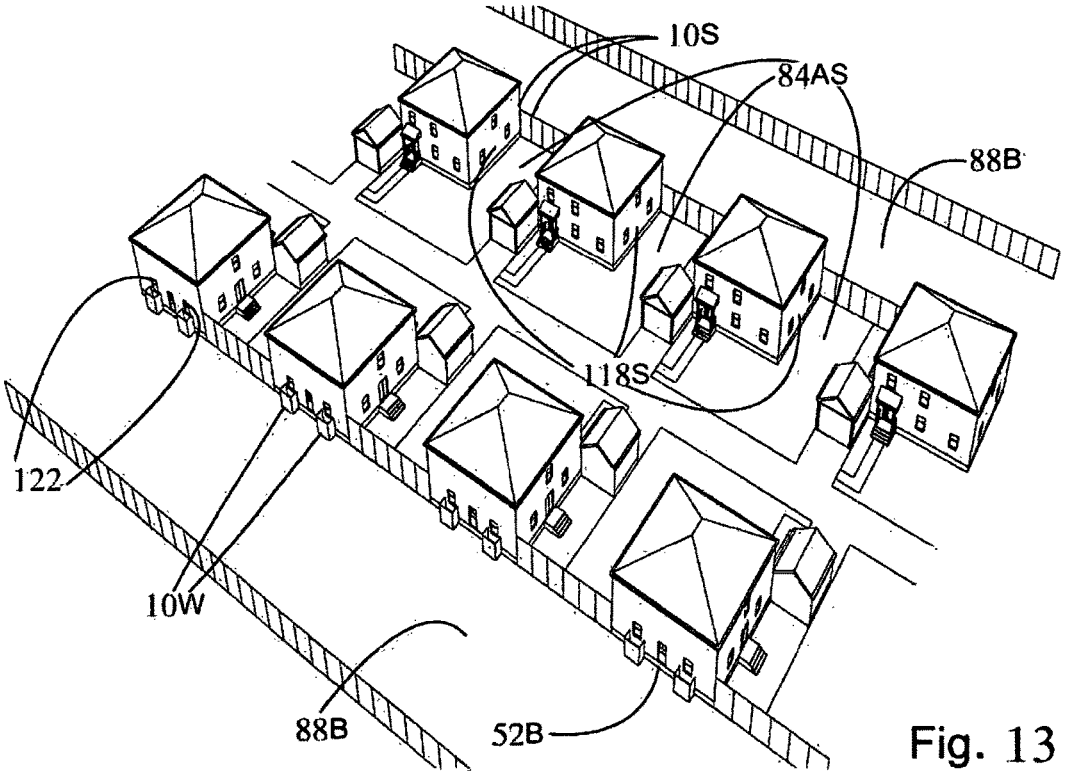
FIG. 13 shows an embodiment where the group b units parking and or common outdoor space is attached at the back relative to group a units' perspective. It also shows a possible group a unit window blocking means for group a windows that overlook a group b secluded outdoor area.

FIG. 13 also locates the group b parking and or common outdoor space (88B) at the back relative to group a's perspective. However in this embodiment the group b parking and or common outdoor space is abuts the back of the dwellings. Group a does not have back yards. The dwellings and a barrier such as a fence or wall (10S) collectively form a barrier to create the group a units segregated abutting outdoor leisure space. So in this embodiment part or all of the barrier around the group b units parking and or common outdoor space also forms the barrier that creates the group a group segregated abutting outdoor leisure space. Group a units do not have a standard use exit into group b's secluded outdoor area. Group a does have windows (122) that overlook group b units' parking and or common outdoor space but the windows have a barrier around them (10W). This barrier can be attached to the ground, the wall, both or by any means. This view blocking means also functions as a barrier so the area inside the fence could be considered part of the group a units group segregated abutting outdoor leisure space.

These windows could be eliminated as was done in the first embodiment, however a window with distorted view material may be the preferred by many people. One or more of these windows could be a door. The barrier could cover a larger area to allow enough room for an extra patio or a place to let a dog or other pet outside. Group a has a useable side yard and patio (84AS). The side yard could be a courtyard. The side yards could be designed so that the high point is at the barrier (10S) allowing the water to drain to the front whereby increasing the effectiveness of the fence or wall portion of the barrier by increasing its relative height.

Each group a unit has a side patio and yard (84AS) that faces a side wall of another group a unit (118S) for which the side patio is on the other side. So each group a unit has a patio that does not face another group a unit patio. The exterior wall of the group a unit that does not have a patio (118S) has windows. These windows could use any above stated view blacking means to achieve neighbor to neighbor privacy. As with any embodiment the parts of the buildings hidden from the view of group a unit occupants can look like apartments, townhouses, houses or any type of housing and not necessarily look like the group a units exteriors giving the group b units a separate identity and look. This area could also have garages, carports or any type of additional structure. The apartment look could be kept down to only below where the barrier keeps group a from seeing the buildings. So the apartment numbers and street numbers could be affixed to the back of the building below the line of sight from the group a units group segregated abutting outdoor leisure space and or from inside the group a units. As with nearly all other features shown, this feature could apply to any embodiment.

The group b units have exits at grade (52B) that exit to their parking and or common outdoor space. As with almost any embodiment the group b units could exit at the second story and use exterior stairs which could have a view blocking means such as louvers that prevents any views to a group a group segregated abutting outdoor leisure space.

Figure 14A:
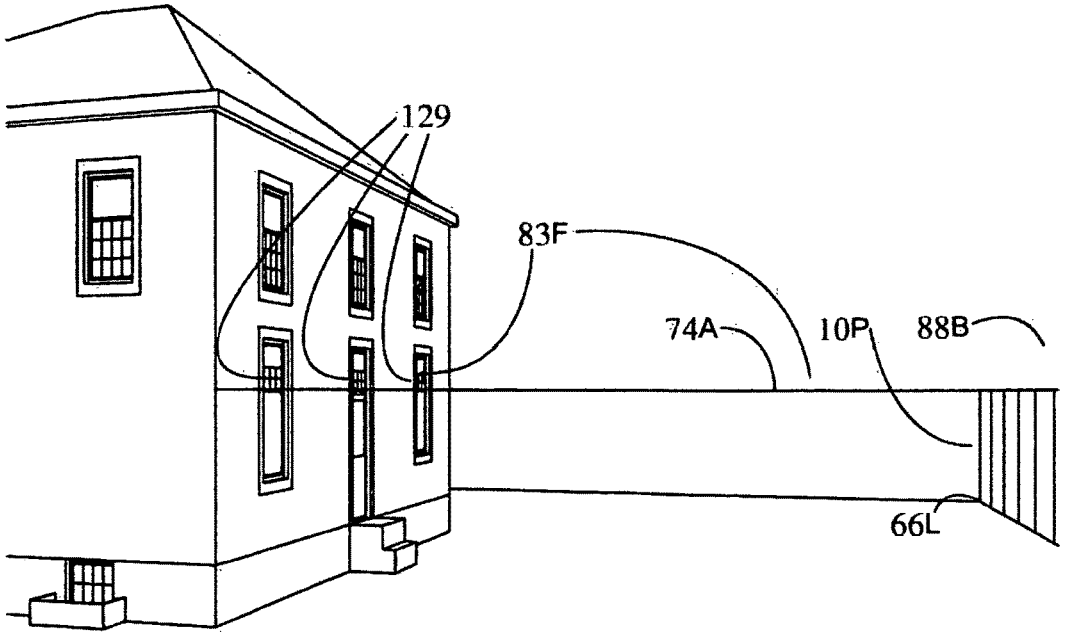
FIG. 14A shows group a unit window views with grading that falls from the back of the building to a barrier.

FIG. 14A shows how the barrier (10P) is in part intended to prevent group a units from seeing over the barrier to the group b units parking and or common outdoor space (88B) that lies beyond the barrier. In this embodiment, the grade of the land falls from the building to the barrier. The low point of the grade is often located at the end of the back yard as in this embodiment (66L). The barrier may not be high enough to prevent views from the elevated height of a person standing inside the group a first floor units (83F). Any person looking from a vantage point higher than the line of sight (74A) would be able to see over the barrier in a downward direction. So FIG. 14A shows the use of distorted view glass (129) from the straight over line of sight (74A) to the height of a person standing inside the group a first floor units (83F). Other view blocking means could be used.

Figure 14B:
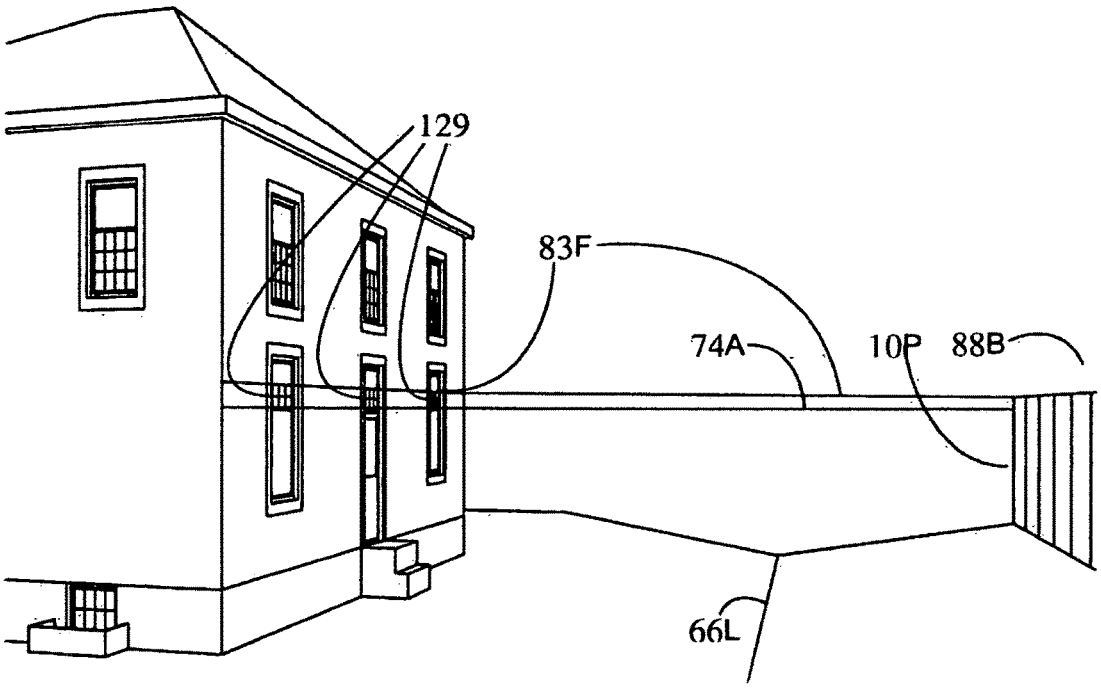
FIG. 14B shows how using special grading and drainage can increase the visual blocking effectiveness of a barrier.

FIG. 14B shows that the grade is changed so that it falls from the building to about the middle of the group a units back yard and the rises to the barrier (10P). The low point of the grade in this embodiment is (66L) is located in the middle of the group a unit back yard. Now because the grade is higher at the barrier compared to FIG. 14A, the same height barrier as shown in FIG. 14A is high enough that the distorted view group a unit material (129) is not necessary as the height at which the barrier with the lower height (74A) blocked the views from inside the group a units has been raised (83F) by the grading and drainage plan. The section of first floor glass block windows are shown in FIG. 14B for explanation purposes but would not be needed after the grade and barrier height change.

Figure 15A:
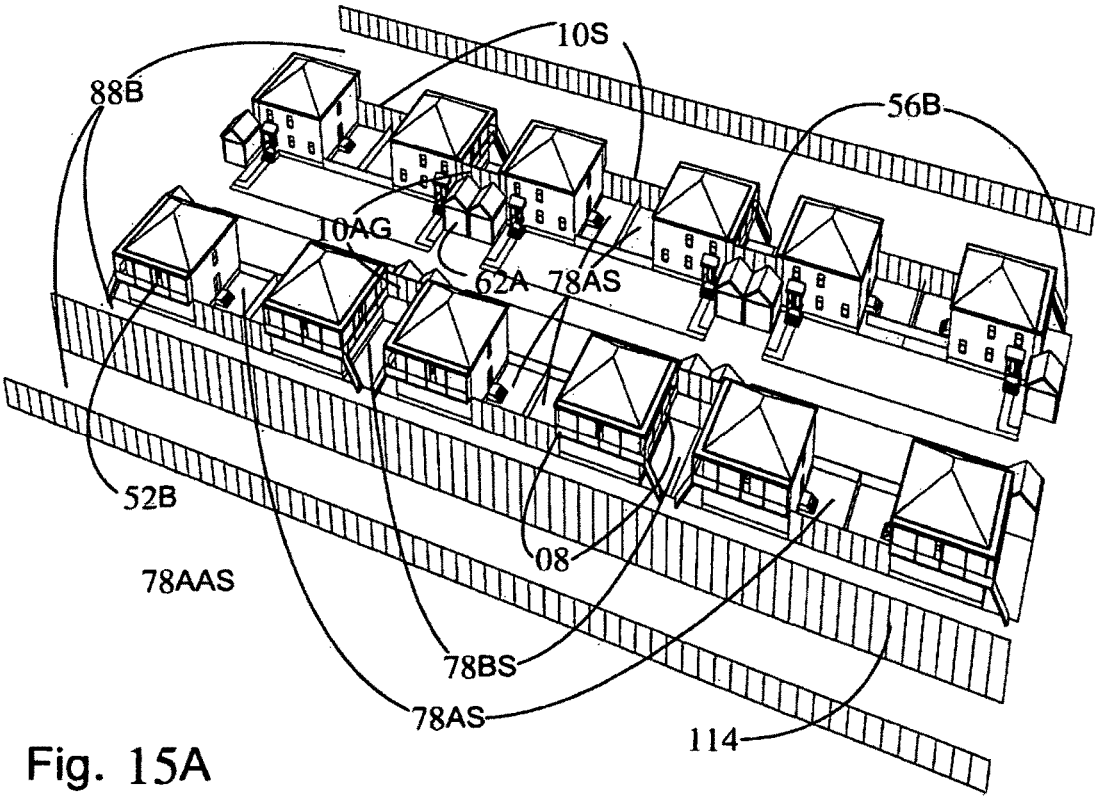
FIG. 15A shows where group b units have a balcony or egress balcony on two sides of each dwelling. It also shows a barrier to block views from the height of the balcony.

Like FIG. 13, FIG. 15A also places the group b parking and or common outdoor space abutting at the back (88B). There could be a walkway, grass, landscaping or other elements between the actual parking and the buildings as may be desired or required by code. In this embodiment group a units occupy and have exclusive access to every other side yard (78AS) that make up part of their group segregated abutting outdoor leisure space and group b units have exclusive access to every other side yard (78BS) that makes up their entire group segregated abutting outdoor leisure space. The barrier at the owners side yards (10S) and the group b parking and or common outdoor space (88B) is a fence or wall. Group a units have garages (62A) and a wall above the garages (10AG) that together provide a barrier at the part of the group b group segregated abutting outdoor leisure space located at the sides of the dwellings. The group b units have balconies (08) on two of the four walls of each dwelling. The group b units could have an exit door from their units (52B) anywhere along the balcony or use interior stairs that exit at or near grade.

From the elevated height of the second story balcony group b occupants could see over a barrier and into the group segregated abutting outdoor leisure space of another set of group privacy dwellings (78AAS not shown). The solution shown in FIG. 15A is to install a two story view blocking means (114). In this embodiment it is installed in the middle of the group b units parking and or common outdoor space. It could be installed at or near the dwellings instead, or at any location that blocks the view as desired.

Figure 15B:
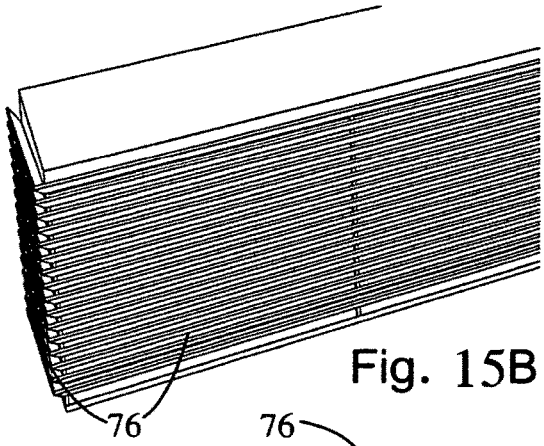
FIG. 15B to 15E shows how louvers could be used to limit views from a balcony.

As shown in FIGS. 15B, C, D and E, another solution is to attach louvers (76) to the balconies. FIG. 15B is a perspective view and shows that a view is provided out in the upward direction, FIG. 15C is a head on view and shows that views directly out or down are not possible. This louver placement and arrangement (76) only allows views in the upward direction. These louvers could work on either balcony location-either located at the back or side relative to group a's perspective.

Figure 15D:
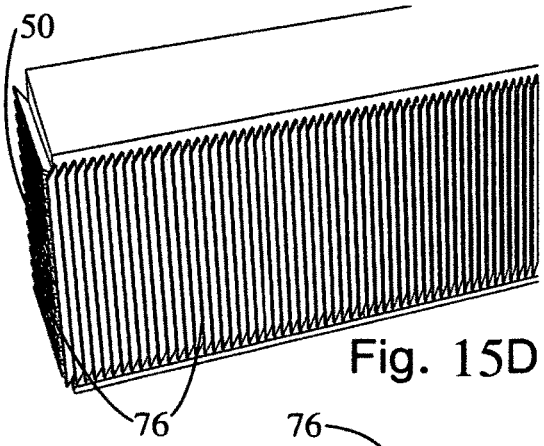
Figure 15C:
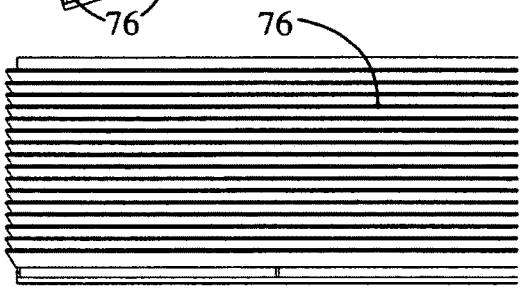
Figure 15E:
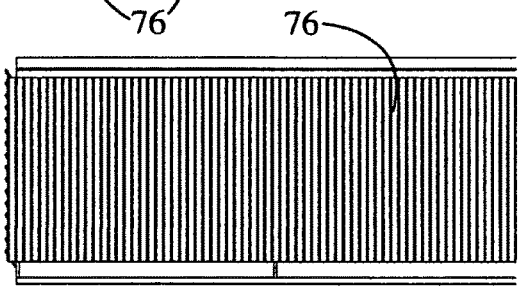

The group b balcony that is located at the side yards relative to group a's perspective could use louvers (76) shown in FIGS. 15D and 15E. These louvers are arranged to only allow views in a left or right direction. In this embodiment from behind the louvers the view is to the right as shown in FIG. 15D. This could be sufficient for the balconies at the side yards. By having the louvers direct the view to the group a garages (62A) as shown in FIG. 15A and the wall above the garage (10AG) where the group a garages and wall prevent views to group a group segregated abutting outdoor leisure space. The end cap (50) on the left side of the balcony in FIG. 15D has the louvers arranged so that the view is in the upward direction as is required to block the view to the group a group segregated abutting outdoor space when looking in that direction.

Again referring to FIG. 15A, an alternate solution would be to build the barrier at the group a side yard (10S) to a height sufficient enough so that group b occupants can not see over it from the elevated height of their balcony and into the group a group segregated abutting outdoor leisure space. Of course another solution could be to eliminate the balconies.

Group b Units Parking and or Common Outdoor Space Located at the Front Relative to Group a Units' Perspective.

FIG. 16A places the group b parking and or common outdoor space (88B) at the front relative to the perspective of group a units. The barrier (10P) around their parking and or common outdoor space is completely provided by a fence or wall. It could be provided by any other barrier means such as garages, carports, storage structures or landscaping. The group b egress discharge are raised walks (40BAG) that transports the group b occupants from their exit doors (52B, not visible) over the group a units segregated abutting outdoor leisure space (all outdoor space except 88B) to the group b parking and or common outdoor space (88B) without the groups seeing or encountering each other. A barrier (10W) is used on each side of the raised walks. The walks could be below ground to pass under the street and could stay underground until they reach the buildings.

A corridor (34) is used to connect each row of buildings. However an egress discharge could be provided at each building eliminating the need for a corridor. The group b discharge stairs (56) are enclosed by lovers (76) to prevent views from the elevated height over the barrier and into group a units' group segregated abutting outdoor leisure space. If a second emergency use group b exit discharges into a group a group segregated abutting outdoor leisure space it could be equipped with a monitoring means, alarm and or a warning sign. Group a streets (100A) have a gate (64) but this is not necessary to achieve group privacy. Group b occupants have no normal means to enter their units if they are not inside their parking and or common outdoor space so that they must use their elevated walks or discharge.

Group a units could park in the same lot as the group b units eliminating the group a units streets. Group b units could have an at grade discharge enclosed with a barrier to get them to their units and group a occupants could simply walk to their units. In this arrangement raised walks are not needed. Alternatively, group a could have an enclosed walk to their units and group b has the fronts as part of a group b unit group segregated abutting outdoor leisure space.

FIG. 16B is the same as FIG. 15A but without the barrier (10P not shown-see FIG. 15A) for the group b parking and or common outdoor space. This helps show how the group b units egress discharge (40BAG) that are raised and enclosed by a barrier (10W) provide the most intimate privacy to the group a units group segregated abutting outdoor space (all outdoor space except 88B).

FIG. 16C also shows a group b secluded outdoor area (88B) oriented towards the front relative to group a units perspective. Here the group b discharge is at grade (40BG) and creates a dead end (38) for the group a streets (100A).

FIG. 16D shows another embodiment where the group group b parking and or common outdoor space (88B) is located at the front relative to the group a units' perspective. The group a units use the group b parking and or common outdoor space as their streets. All outdoor space except (88B) is group a units group segregated abutting outdoor space. Group a units could or could not have a security gate (64A) at the entrance to their driveways (48A). Group b units discharge at grade (40B) and the discharges are enclosed by a barrier (10B). In this embodiment the group b units exit at grade (52B) but could exit at the second story and use exterior stairs with a view blocking means such as louvers that allow light to flow in and smoke to flow out which may help meet building codes. Group a units are the only units that have a normal means to access the yards attached to the dwellings and are the only units with group segregated abutting outdoor leisure space. However, in other embodiments group b units could have garages attached to the dwellings and then could convert their parking and or common outdoor space into group segregated abutting outdoor leisure space.

In FIG. 16E group a units again use the secluded group b outdoor area (88B) as their streets and could or could not have a security gate (64A) at the entrance to their driveway (48A). In this embodiment group b units have access to the yards or space attached to the front of the buildings so this becomes their group segregated abutting outdoor leisure space (78B). The group b units again exit at grade (52B) but as with most embodiments could use exterior stairs and exit at the second story or higher stories-if any.

Shared Streets

FIG. 17A shows that the two groups of units share the same streets (100S). Group b's parking and or common outdoor space (88B) is at the side relative to group a units perspective. The entrance to the group b parking and or common outdoor space (32B) is directly from the shared streets. Group b egress discharge (40) travels through group a's group segregated abutting outdoor leisure space (all outdoor space except 88B) and is enclosed by a barrier (10). Group b exit doors are at grade (52B) but could be at the second story.

FIG. 17B again has the two groups of units sharing streets but places the group b parking and or common outdoor space (88B) at the back relative to group a units' perspective. The entrance to the group b parking and or common outdoor space (32B) is directly from the shared streets (100S). In this embodiment group b units parking and or common outdoor space is detached from the buildings and all of the yards abutting the dwellings are part of the group a units group segregated abutting outdoor leisure space. For this reason, group b units walks or discharge from their parking and or common outdoor space to their exit doors (52B) are enclosed on the sides with a barrier (40), (10) as they egress discharge through the group a group segregated abutting outdoor leisure space. The group b parking and or common outdoor space has a barrier (10P). The group b parking and or common outdoor space could be attached, or abut the back of the buildings.

FIG. 17C again shows both groups of units sharing the same streets (100). In this embodiment group b's parking and or common outdoor space (88B) is the area between two buildings. This area could extend further up or back and include more space. The buildings and a barrier (10P) provide the physical and visual blocking. The group b parking and or common outdoor space could have a gate (64). The group b units exit at grade (52B) but could exit at the second story and use exterior stairs with a view blocking means to prevent or reduce views to the group a secluded outdoor areas.

FIG. 17D is similar to FIG. 11C except that each building has a separate group b unit parking and or common outdoor space (88B). In any of these embodiments group b could have garages attached to the dwellings and the area that is now considered parking and or common outdoor space could become group b units group segregated abutting outdoor space.

FIG. 18 shows that group a uses group b units parking and or common outdoor space (88B) as roads to get to their group segregated abutting outdoor leisure space (everything except 88B). There is a security gate (64) which is not required to enter the group a streets (100A). Group b uses a corridor (34) to egress between buildings and over or under group a units group segregated abutting outdoor leisure space. Walks at grade with a barrier, an egress balcony or other means would also work. In this embodiment the group b units exit at the second story (52B) and use exterior stairs (56) without a view blocking means to group a units secluded outdoor areas as the view is fairly limited and blocked by the buildings.

FIG. 19A is an embodiment in which the two groups of units have separate streets (100A, 100B) and each group has what appears to be a front elevation. In this embodiment the buildings, garages and a barrier (10S) provide the separation between a group segregated abutting outdoor leisure space for each group (78A, 78B). The remaining outdoor areas either belong to group b units or to the public or could belong to group a units. Not all areas need be enclosed by a barrier with any embodiment. In this embodiment group a units have a completely enclosed outdoor area. The group b units outdoor area is segregated from the group a units outdoor area and are open to the roads on both sides of the buildings. The group a streets (100A) are separate from the group b streets (100B). In this embodiment the group a streets in front of their units have a gate (64).

FIG. 19B is the same as FIG. 19A except the two groups of units share a feeder street (100F). This sharing of the feeder street provides less privacy between the inhabitants of the two groups of units but could eliminate the cost of a street compared to FIG. 19A.

Three or More Groups of Secluded Outdoor Areas

FIG. 19C is similar to FIGS. 19A and 19B except that in addition to the two group segregated abutting outdoor leisure spaces (88A, 88B) it adds a group c parking and or common outdoor space (88C). In this embodiment this group c parking and or common outdoor space only accesses the building that it abuts—not all three of the buildings in each row—as could be the case with any similar embodiment. If all three buildings were to use the group c parking and or common outdoor space (88C) a means to connect the units of the two buildings that are not attached to the group c units parking and or common outdoor space would be required such as an above or below grade corridor or above grade walks or egress balcony with a barrier around them. Another alternative is for the buildings to be attached.

FIG. 20 shows an embodiment with eight areas that are either parking and or common outdoor space or group segregated abutting outdoor leisure space. (88A, 88B, 88C, 88D,88E,88F, 88G, 88H). The outdoor areas that are located at what appears to be the fronts of the dwellings use above grade discharges (40). The side outdoor areas (88B, 88H) also serve as streets for the groups of units associated with the other outdoor areas. There could also be one or more group segregated abutting outdoor leisure space on the roofs, below grade or at remote locations, although these may not be abutting. Not all groups of units have a completely segregated or private outdoor area that is completely segregated from all other groups of units outdoor areas.

FIG. 21 is an embodiment with three groups of units in the community. A parking and or common outdoor space for the group b units (88B) are built into the buildings on the right. The (88B) parking and or common outdoor space has its own community entrance (32B) and community entrance sign (33B) with attached words, logos or other items to identify the community. A parking and or common outdoor space for group c units (88C) are built into the buildings on the left. It has its own community entrance (32C) and community entrance sign (33C) with attached words, logos or other items to identify the community. Each of these two parking and or common outdoor spaces could have their own identity and the buildings could look different to each group. For example one group could be apartments and the other office space. The remaining outdoor area on both the left and the right sides of group b and group c units parking and or common outdoor spaces belongs is group a units group segregated abutting outdoor leisure space. Both group b and c units parking and or common outdoor space are completely separated from the group a units group segregated abutting outdoor leisure space by the dwellings and a barrier (10P) such as a fence.

The group b and c units parking and or common outdoor space have an opening (11) in the barrier that separates their outdoor areas (10M). This arrangement could allow for apartment renters to occupy group b units and office space to occupy group c units. The barrier openings (11) allow parking from one side to flow to the other side thus reducing the required parking spaces by as much as 50% as office parking and apartment parking usage peaks at complementary times of the day and week. In this embodiment the group a units have a group segregated abutting outdoor leisure space that is segregated from the other two groups. The group b and group c units parking and or common outdoor space are not completely segregated from each other so that they can benefit by sharing the parking area in a way that better utilizes the outdoor parking space. The group a group segregated abutting outdoor leisure space could be split into two groups if desired at each entrance.

Window or Voids View Blocking Means

Figure 22A:
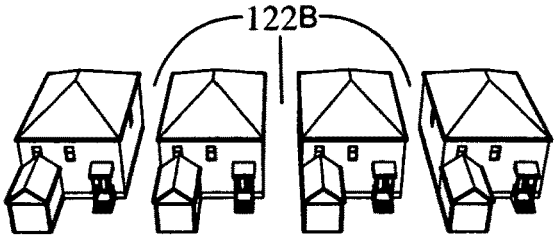

FIG. 22A shows how the windows to include bedroom EE&R windows—if any—could be placed by group. The side walls indicated by (122B) could be the only walls for which group b units would have windows below the line of sight without a view blocking means, or operable windows below the line of sight.

Each or any embodiment could be limited to non operable windows or non operable windows within the line of sight to the other groups group segregated abutting outdoor leisure space or voids. This is because non operable windows could not be considered a group privacy concern or the windows could be treated with a view blocking means.

Figure 22B:
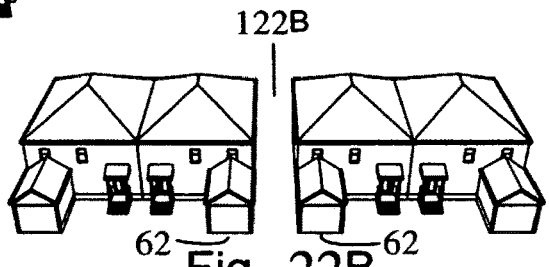

FIG. 22B shows twin or duplex group a units attached at one side. The garages (62) are placed at the sides to help improve group privacy for group b unit windows placed at the sides (122B)—if any. These windows could have an additional view blocking means limiting the views to the back yards of the group a units group segregated abutting outdoor leisure space.

Figure 22C:
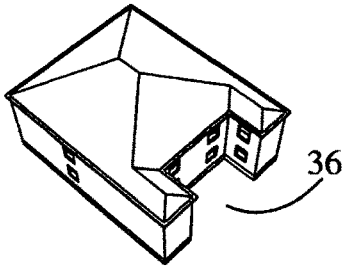

FIG. 22C shows that the dwelling has a three sided courtyard (36) to help limit views from the windows of one or more groups.

Figure 22D:
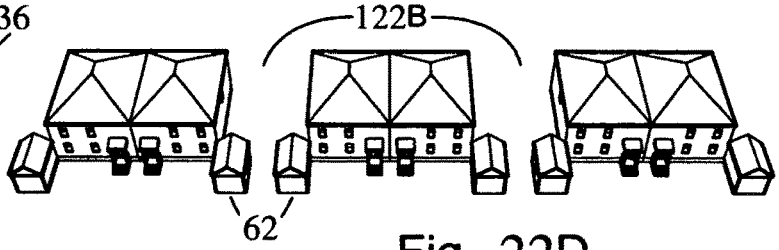

FIG. 22D shows how the garages (62) of twin dwellings are placed off to the side of the dwellings to partially block the views of the windows (122B) placed on the side walls relative to group a units perspective.

Figure 22E:
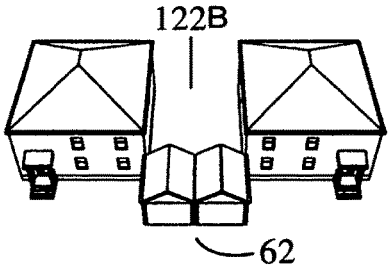

FIG. 22E shows how the garages (62) of a single home are offset and attached on an adjoining side to block views from windows (122B) placed on the sides.

FIG. 23 shows a dormer can be used to limit views. The depth of the dormer could be lengthened to further restrict the view. The dormer could also have any view blocking means installed inside of it or outside to further reduce or eliminate views while allowing light and possibly air to flow. In this embodiment the dormer is mounted protruding from the roof. The dormer could be mounted on an exterior wall to perform a function similar to what is shown in FIG. 24.

FIG. 24 shows an exterior window attachment to restrict or eliminate views (114). Any piece or part of the view blocking means could be lengthened, shortened, removed, angled, louvered or otherwise changed to limit the view as desired. The attachment could be a plant shelf, shutters or a real or false balcony or any other attachment that looks or is functional or it could simply be attached to limit views without being or looking functional. It could be attached on the exterior, interior or between two panes of glass or inside of a dormer or other means. Here the attachment is three sided—the left and right sides and the bottom. another attachment could be added to the two side attachments to further limit views. This window view blocking means may be preferable when the windows are operable and would otherwise have a view of another groups secluded outdoor area or voids. The alternative of distorted view glass as discussed in the first embodiment may not be effective when the window is open and the distorted view material no longer blocks the view as intended.

FIGS. 25A and 25B show fixed horizontal louvers (76H) used to limit views to out and up. FIG. 25A shows the straight on view which is a wall of louvers as the louvers are fixed in the upward direction and slightly overlap not allowing a view directly out or out and in the downward direction. FIG. 25B shows that a person looking out and up would have a clear view except for the thin leading edge of the louver. Thus this arrangement allows for views out and up and allows light to flow in without allowing views out and down to the other groups secluded outdoor areas or voids. These louvers could be interior, exterior or placed anywhere including between two panes of glass or within a dormer.

FIG. 26A shows a straight on view of fixed vertical louvers (76V) arranged to limit the views to one side. When looking straight on the viewer can not see out of the window. FIG. 26B shows when looking from the right a person can see out and to the left. Again the lover placement can vary.

FIGS. 25A, 25B, 26A, 26B show that the louvers do not cover the entire window as in this embodiment the portion of the window above the louvers is high enough that a normal person could only see out and up towards the sky and not downward to an outdoor area located at or near ground level. Windows above the line of sight do not need to be attached to a window below the line of sight as is often showed here for clarity.

Any of the above view blocking means can be used to reduce or eliminate views to the other groups secluded outdoor area or voids. As shown in the first embodiment, non clear view material is also an option as is operable windows being limited to certain walls or certain heights.

FIG. 27 is an embodiment where the group a and group b units split the outdoor area that appears to be the back yards relative to group a units perspective. Group b units group segregated abutting outdoor leisure space are indicated by (88B) and group a's by (88A). The group segregated abutting outdoor spaces could be divided up in any number of ways.

FIG. 29A shows a community of existing buildings. FIG. 29B shows how group privacy features can be added to these buildings one building and one feature at a time. An entire community could also be retrofitted with these features. A barrier (10) can be installed around one, two or more buildings to create group a or b group segregated abutting outdoor leisure space or group b parking and or common outdoor space. Exterior stairs (56) with a view blocking means such as louvers can be added. A parking area (85) can be added. An egress discharge (40) or a walkway from the building to the parking can be enclosed by a barrier (TOED). The egress discharge could use any means such as those discussed in FIGS. 6A-6D to limit views due to differences in grade or for any reason. Rear windows (122) have been added or existing windows replaced which have a view blocking means as discussed in the window FIGS. FIG. 29B shows buildings with several features added for clarity, but one feature at a time can be added. Group b could have group segregated abutting outdoor leisure space at the back, sides or other locations relative to group a units perspective.

REFERENCE NUMERALS

08 balcony, egress balcony
10 barrier
11 barrier opening
12 bedroom
22 bridge or built up span
30 clubhouse/amenities
32 community entrance
33 community entrance sign
34 corridor
36 courtyard
38 dead end
40 discharge
44 door
46 drain pipe
48 driveway
49 egress access
50 end cap
52 exit door
54 exit, second or emergency use
56 exterior stairs or steps
57 fall
62 garage/carport/storage
64 gate
66 grading and drainage
69 interior stairs or steps
74 line of sight
76 louvers
78 group segregated abutting outdoor leisure space
83 estimated occupant standing eye height
84 patio, deck or the like
85 parking area
88 parking and or common outdoor space
90 secluded outdoor space built
100 street
110 unit or units
114 view blocking means
118 wall, exterior
122 window
124 window, bedroom emergency escape & rescue window
126 window, below grade
129 window, distorted view means
144 window well

The invention claimed is:

1. A community comprising:

a. at least two group privacy structures; wherein each of the at least two group privacy structures are multi unit structures comprising a shared corridor that is shared between the at least two group privacy structures; wherein each group privacy structure comprises at least one a unit and at least one b unit; wherein the at least one a unit and the at least one b unit are separate units, b. at least two outdoor spaces respectively connected to one of the at least two group privacy structures and comprising at least one group a segregated outdoor space and at least one group b segregated outdoor space; wherein the outdoor spaces at least in part abut each other, c. wherein the at least one group a segregated outdoor space includes one or more of the following for the group a units: parking, enclosed parking, partially enclosed parking, a hard surface providing access to the parking; wherein the at least one group a segregated outdoor space comprises at least one entrance area, d. a visual and physical barrier, wherein the visual and physical barrier visually and physically separates the b unit from the group a unit segregated outdoor space, and e. a group a unit egress through the visual and physical barrier that connects and permits egress by the group a unit to the group a segregated outdoor space and that is not accessible to the b unit; wherein at least one of the group b units has window material that overlooks a group a segregated outdoor space, wherein there is a predetermined line of sight in which views out of the window material are in the upward or downward direction; wherein the window material uses a distorted view material below the predetermined line of sight; wherein views out of the b unit window material that are in the downward direction are viewed through a distorted view material.

2. The community of claim 1 wherein most or all parking for the group b units is at ground level or within 5 feet of a surrounding ground level.

3. The community of claim 1 wherein most or all of the group b parking is outdoor parking, open to above.

4. The community of claim 1 wherein most or all parking for the group a units is at ground level or within 5 feet of a surrounding ground level.

5. The community of claim 1 wherein most or all group a units have separate parking regions.

6. The community of claim 5 wherein the separate parking regions are separate enclosed garages.

7. The community of claim 6 wherein the enclosed garages are attached to the a units.

8. The community of claim 1 wherein most or all of the group a segregated outdoor space is at ground level or within 5 feet of a surrounding ground level.

9. The community of claim 1 wherein most or all structures comprise above ground level stories.

10. The community of claim 1 wherein the barrier comprises at least one gate; wherein the gate provides access for at least one of the a units to the group b secluded outdoor space.

11. The community of claim 1 wherein at least one group b units' emergency use exit exits to the group a segregated outdoor space.

12. The community of claim 1 wherein the group a units occupy most or all of the space that is built closest to ground level.

13. The community of claim 1 wherein the window material below the line of sight is inoperable.

14. The community of claim 1 wherein the window material above the line of sight is a clear view material.

15. The community of claim 1 wherein at least one of the group b units has window material that overlooks a group a segregated outdoor space; wherein there is a predetermined line of sight in which views out of the window material are in the upward or downward direction; wherein the window material uses louvers below the predetermined line of sight; wherein the louvers are arranged such that views out of the b unit window material that are below the predetermined line of sight are viewed through the louvers substantially only in an upward direction.

16. The community of claim 15 wherein the window material below the line of sight is inoperable.

17. The community of claim 1 wherein at least one of the group b units use one or more of the following: at least one exterior step that is at least in part above grade; wherein at least part of the view from the at least one exterior step overlooks at least a part of a group a segregated outdoor space; wherein the step offers views in the upward, downward and straight out directions; wherein at least the part of the exterior step that is above grade and overlooks the at least part of a group a segregated outdoor space uses louvers; wherein the louvers are placed or arranged such that views out from the step are in the straight out or upward direction.

18. The community of claim 1 wherein at least some of the barrier is one or more of; landscaping, bush, plant, tree, any landscape element, any means to at least in part inhibit views between the two outdoor spaces.

19. The community of claim 1 wherein at least one group a unit has access to at least one group b segregated outdoor space from inside the group a unit.

20. The community of claim 1 wherein at least one group a unit has access to at least one group b segregated outdoor space from at least one group a segregated outdoor space.

21. The community of claim 1 wherein most or all of the group b units are placed mostly or completely above at least part of one group a unit.

22. The community of claim 1 wherein most or all of the group b units are placed mostly or completely behind at least part of one group a unit.

23. The group privacy structure of claim 1 wherein the visual and physical separation barrier further comprises a wall of a corridor inside the at least one group privacy structures.

24. A structure comprising:

at least two units comprising at least one a unit and at least one b unit; wherein the a unit and the b unit are separate units;

a visual and physical barrier that visually and physically separates the b unit from an outdoor area; and an a unit egress through the visual and physical barrier that connects and permits egress by the a unit to the outdoor area and that is not accessible to the b unit, wherein at least part of at least one wall of the b unit has a see through section; wherein the see through section at least in part overlooks the outdoor area that the a unit has direct access to, wherein there is a predetermined line of sight in which views out of the see through section are in a direction that provides a view of the outdoor area that the a unit has direct access to, wherein the see through section uses at least one or more of the following view blocking means at the predetermined line of sight: louver, shelf, ledge, balcony, attached structure; wherein the one or more view blocking means is arranged such that views out of a b unit window that are in the direction of the outdoor area that the a unit has direct access to are viewed through the one or more view blocking means in a way that at least in part limit views to the outdoor area that the a unit has direct access to.

25. The structure of claim 24 wherein the see through section that uses the one or more view blocking means is inoperable.

26. The structure of claim 24 wherein the see through section that are not in the direction of the outdoor area that the group a unit has direct access to uses a clear view material.

27. The structure of claim 24 wherein the clear view material that is not in the direction of the outdoor area that the group a unit has direct access to and uses a clear view material, is operable.

28. A structure comprising:

at least two units comprising at least one a unit and at least one b unit; wherein the a unit and the b unit are separate units, wherein the a unit has direct access to an outdoor area; wherein the b unit does not have same said direct access to said outdoor area, wherein the b unit has at least one step that is elevated above the surrounding ground level; wherein there is a predetermined line of sight from said step to said outdoor area that the a unit has direct access to, wherein said elevated height of said step provides an enhanced view below said predetermined line of sight in the direction of said outdoor area that said a unit has direct access to, wherein said step uses at least one or more of the following view blocking means at or near said predetermined line of sight: louver, shelf, ledge, attached structure; wherein said one or more view blocking means is arranged such that views out from the b unit step that are in the direction of said outdoor area that the a unit has direct access to are viewed through said one or more view blocking means in a way that at least in part limits views to said outdoor area that the a unit has direct access to.

* * * * *